US006343051B1

(12) United States Patent
Yabe et al.

(10) Patent No.: US 6,343,051 B1
(45) Date of Patent: Jan. 29, 2002

(54) PORTABLE ELECTRONIC DEVICE AND CONTROL METHOD FOR THE PORTABLE ELECTRONIC DEVICE

(75) Inventors: Hiroshi Yabe, Shiojiri; Makoto Okeya, Nagano-ken, both of (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/458,838

(22) Filed: Dec. 13, 1999

(30) Foreign Application Priority Data

Dec. 14, 1998 (JP) ..... 10-355249
Oct. 5, 1999 (JP) ..... 11-284402

(51) Int. Cl.[7] ..... G04B 1/00; G04B 9/00; G04C 3/00

(52) U.S. Cl. ..... 368/64; 368/66; 368/204

(58) Field of Search ..... 368/64, 66, 203–205

(56) References Cited

U.S. PATENT DOCUMENTS 5,001,685 A * 3/1991 Hatakawa ..... 368/204
5,581,519 A * 12/1996 Hara et al. ..... 368/64
5,740,132 A * 4/1998 Ohshima et al. ..... 368/204
5,822,278 A * 10/1998 Ohshima et al. ..... 368/204

* cited by examiner

*Primary Examiner*—Vit Miska

(57) ABSTRACT

A reliable power supply control function in a portable electronic device which includes a limiter circuit, or includes the limiter circuit and a voltage step-up circuit, to reduce power consumption. It is detected whether or not a voltage generated by a power generator 40 or a voltage accumulated in a power supply device 48, 80 exceeds a preset limiter-ON voltage. When the voltage generated by the power generator 40 or the voltage accumulated in the power supply device 48, 80 has become not lower than the preset limiter-ON voltage, a voltage of electrical energy supplied to the power supply device is limited to a predetermined reference voltage set in advance. When it is determined based on a detection result of a status-of-power-generation detecting section 91 that power is not generated by the power generator 40, detecting operation of a limiter-ON-voltage detecting circuit 91A is prohibited. Power consumption required for operating the limiter-ON-voltage detecting circuit can be thus reduced.

20 Claims, 15 Drawing Sheets

| VOLTAGE STEP-UP FACTOR | CONNECTION | SW1 | SW2 | SW3 | SW4 | SW11 | SW12 | SW13 | SW14 | SW21 |
|---|---|---|---|---|---|---|---|---|---|---|
| 3 TIMES | PARALLEL | ON | OFF | ON | OFF | ON | OFF | ON | OFF | OFF |
| | SERIAL | OFF | ON | OFF | OFF | OFF | OFF | OFF | ON | ON |
| 2 TIMES | PARALLEL | ON | OFF | ON | OFF | ON | OFF | ON | OFF | OFF |
| | SERIAL | OFF | ON | OFF | ON | OFF | ON | OFF | ON | OFF |
| 1.5 TIMES | PARALLEL | ON | OFF | OFF | OFF | OFF | OFF | ON | OFF | ON |
| | SERIAL | OFF | ON | OFF | ON | OFF | ON | OFF | ON | OFF |
| NO STEP-UP | PARALLEL | OFF | ON | ON | ON | OFF | ON | ON | ON | OFF |
| | SERIAL | OFF | ON | ON | ON | OFF | ON | ON | ON | OFF |
| 1/2 TIMES | PARALLEL | ON | OFF | OFF | OFF | OFF | OFF | ON | OFF | ON |
| | SERIAL | ON | OFF | OFF | ON | ON | OFF | OFF | ON | OFF |

FIG. 3

3-TIMES STEPPED-UP
| | | CHARGING VOLTAGE | VOLTAGE | X2 VOLTAGE | X1.5 VOLTAGE |
|---|---|---|---|---|---|
| SOLAR CELL | 50,000LX | 1.50V | 4.50V | 3.00V | 2.25V |
| | 1,000LX | 1.01V | 3.03V | 2.02V | 1.52V |
| ELECTROMAGNETIC INDUCTION MOTOR | STRONG HAND SWING | 2.00V | 6.00V | 4.00V | 3.00V |
| | WEAK HAND SWING | 1.02V | 3.06V | 2.04V | 1.53V |
CHARGING VOLTAGE = INITIAL VOLTAGE + INTERNAL RESISTANCE DURING CHARGING X CHARGING CURRENT
FIG. 8
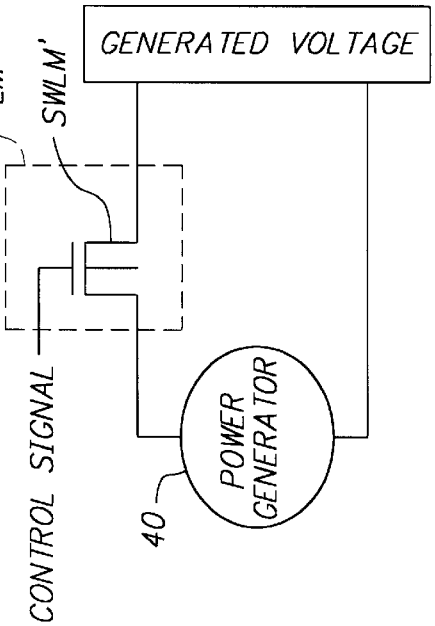
FIG. 14B
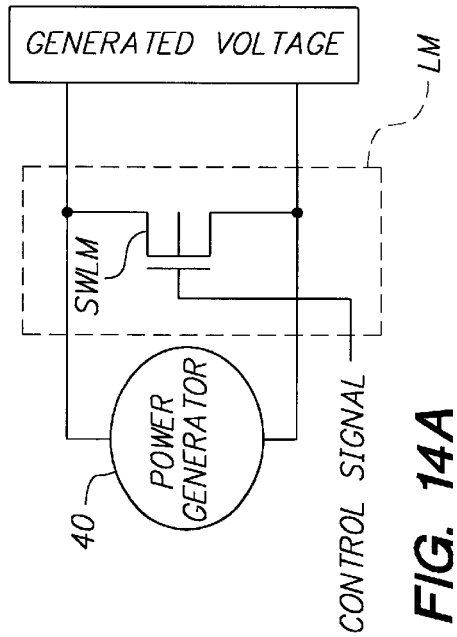
FIG. 14A

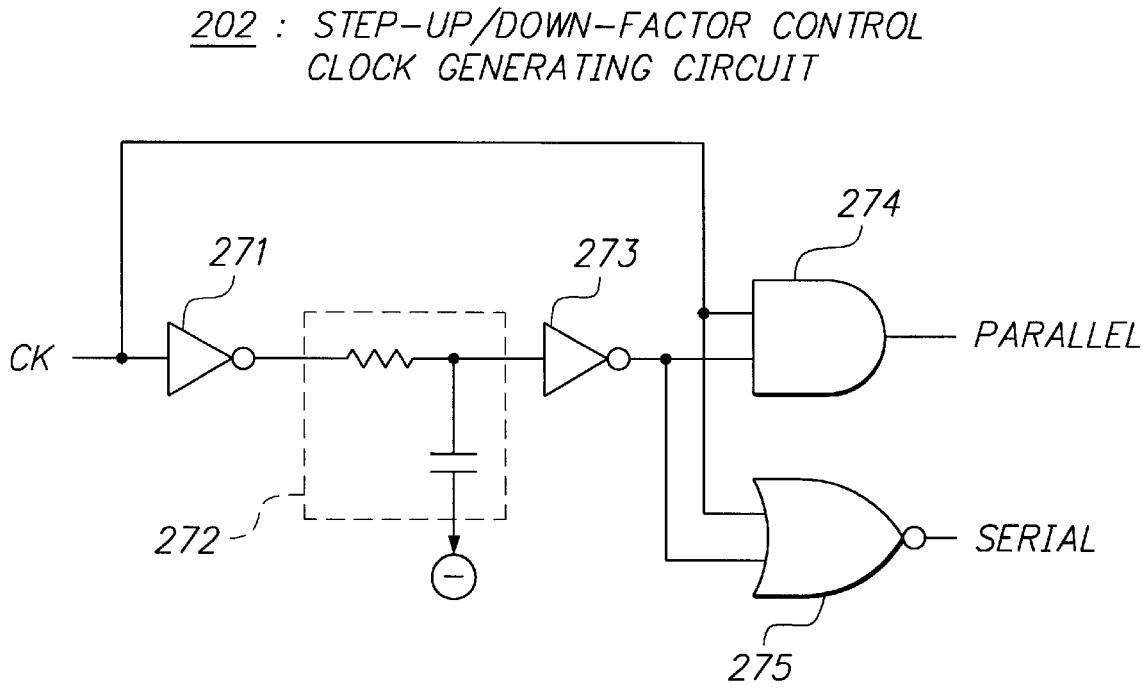
FIG. 16
| Q3 | Q2 | Q1 | |
|---|---|---|---|
| 0 | 0 | 0 | 3 TIMES |
| 0 | 0 | 1 | 2 TIMES |
| 0 | 1 | 0 | 1.5 TIMES |
| 0 | 1 | 1 | NO STEP-UP |
| 1 | – | – | 1/2 TIMES |
FIG. 18
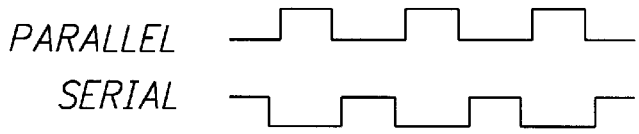
FIG. 19

PORTABLE ELECTRONIC DEVICE AND CONTROL METHOD FOR THE PORTABLE ELECTRONIC DEVICE

BACKGROUND OF THE INVENTION

1. Field of the Invention

The present invention relates to a portable electronic device and a control method for the portable electronic device, and more specifically, it relates to a power supply control technique in an electronically controlled portable timepiece that incorporates a power generating mechanism.

2. Description of the Related Art

Recently, small-sized electronic timepieces in the form of, e.g., wristwatches have been developed. These timepieces incorporate a power generator such as a solar cell and operate without replacing batteries. These electronic timepieces charge large-capacitance capacitors with electric power generated by power generators, and indicate the time of day with the power discharged from the capacitors when power is not generated. These electronic timepieces can therefore operate stabily for a long time without batteries. Given the inconvenience of replacing batteries and problems incidental to disposal of exhausted batteries, it is expected that power generators will be incorporated in more and more electronic timepieces in the future.

In such an electronic timepiece incorporating a power generator, a limiter circuit for limiting a source voltage is provided to prevent a voltage generated by the power generator from exceeding the voltage tolerance level of a power supply unit having an electricity accumulating function, e.g., a large-capacitance capacitor, or to prevent a source voltage applied from the power supply unit to a time indicating circuit from exceeding the voltage tolerance level of the time indicating circuit.

In order to prevent a voltage generated by the power generator from exceeding the voltage tolerance level of the power supply unit, or prevent a source voltage applied from the power supply unit to the time indicating circuit from exceeding the withstanding voltage tolerance level of the time indicating circuit, the limiter circuit operates to electrically disconnect the power supply unit from the power generator at a point upstream of the power supply unit, or electrically disconnects the power supply unit from the time indicating circuit at a point downstream of the power supply unit, or short-circuits the output terminals of the power supply unit to prevent the generated voltage from being transmitted to downstream components.

However, in order to provide a stable power supply, an electronic timepiece incorporating a power generator is constructed such that when the power generator does not generate power for a predetermined time or longer, this condition is detected to shift the operation mode from a normal operation mode (indicating mode) in which the time of day is indicated, to a power-saving mode in which the time of day is not indicated.

Operating the limiter circuit requires a voltage detecting circuit for detecting the applied voltage, and the voltage detecting circuit increases power consumption. Particularly, when the voltage detecting circuit is constructed of a circuit for detecting voltage with high precision, there arises a problem of increasing both the circuit scale and power consumption.

Further, in order to prolong the operating time, an electronic timepiece incorporating a power generator includes a voltage step-up circuit for stepping up a source voltage to produce voltages for driving downstream circuits. However, unless a step-up factor of the voltage step-up circuit is correctly set, a voltage exceeding the voltage value suitable for operation or the absolute rated voltage is applied to the circuits, and in the worst case, the electronic timepiece would be damaged.

OBJECTS OF THE INVENTION

Therefore, it is an object of the present invention to overcome the aforementioned problems.

Accordingly, the object of the present invention is to realize a reliable power supply control function in a portable electronic device which includes a limiter circuit for limiting a source voltage, or includes the limiter circuit and a voltage step-up circuit, and to provide a portable electronic device and a control method for the portable electronic device with which power consumption can be reduced.

SUMMARY OF THE INVENTION

To solve the problems set forth above, a portable electronic device according to the present invention comprises a power generator or generating means for generating power through conversion from first energy to second energy in the form of electrical energy; a power supply or power supply means for accumulating the electrical energy produced by the power generation; a for accumulating the electrical energy produced by the power generation; a driven unit or means driven with the electrical energy supplied from the power supply; a power-generation detector or detecting means for detecting whether or not power is generated by the power generator; limiter-ON-voltage detector or detecting means for detecting whether or not a voltage generated by the power generator or a voltage accumulated in the power supply exceeds a preset limiter-ON voltage; a limiter or limiter means for limiting the voltage of the electrical energy to be supplied to the power supply to a predetermined reference voltage set in advance when it is determined, based on a detection result of the limiter-ON-voltage detector, that the voltage generated by the power generator or the voltage accumulated in the power supply has not been reduced below the preset limiter-ON voltage; and limiter-ON-voltage detection prohibiting unit or means for prohibiting the detecting operation of the limiter-ON-voltage detector when it is determined, based on a detection result of the power-generation detector, that power is not generated by the power generating means.

Also, the limiter-ON-voltage detection prohibiting unit may include an operation stopping unit or means for stopping operation of the limiter-ON-voltage detector to prohibit the detecting operation of the limiter-ON-voltage detector.

In addition, the portable electronic device may further comprise a generated-voltage detector or detecting means for detecting a voltage generated by the power generator, and the limiter-ON-voltage detection prohibiting unit may include a limiter-ON-voltage detection controller or control means for prohibiting the detecting operation of the limiter-ON-voltage detector when it is determined, based on a detection result of the generated-voltage detector, that the generated voltage does not exceed a predetermined limiter control voltage that is lower than the limiter-ON voltage, and allowing the detecting operation of the limiter-ON-voltage detector when the generated voltage exceeds the predetermined limiter control voltage.

Further, the portable electronic device according to the present invention may further comprise a limiter-ON unit or means for bringing the limiter into an operative state when it is determined, based on the detection result of the limiter-ON-voltage detector, that the voltage generated by the power generator or the voltage accumulated in the power supply has exceeded the preset limiter-ON voltage; and an operating-state controller or control means for bringing the limiter into an inoperative state when the limiter is in the operative state, and also when it is determined, based on the detection result of the power-generation detector, that power is not generated by the power generator or when it is determined, based on the detection result of the generated-voltage detector, that the generated voltage does not exceed the predetermined limiter control voltage that is lower than the limiter-ON voltage.

Also, the limiter-ON-voltage detector detects whether or not the voltage accumulated in the power supply means exceeds the preset limiter-ON voltage, with a cycle not larger than the cycle necessary for detecting a change of the voltage generated by the power generator.

A portable electronic device according to the present invention comprises a power generator or generating means for generating power through conversion from first energy to second energy in the form of electrical energy; a power supply or power supply means for accumulating the electrical energy produced by the power generation; a source-voltage stepping-up unit or means for stepping up a voltage of the electrical energy supplied from the power supply at a step-up factor n (where n is a real number larger than 1) and supplying the stepped-up voltage as driving power; a driven unit or means driven with the driving power supplied from the source-voltage stepping-up unit, a power-generation detector or detecting means for detecting whether or not power is generated by the power generator; a limiter-ON-voltage detector or detecting means for detecting whether or not at least one of a voltage generated by the power generator, a voltage accumulated in the power supply, and a voltage of the driving power after being stepped up exceeds a preset limiter-ON voltage; a limiter unit or means for limiting the voltage of the electrical energy to be supplied to the power supply to a predetermined reference voltage set in advance, when it is determined, based on a detection result of the limiter-ON-voltage detector, that at least one of the voltage generated by the power generator, the voltage accumulated in the power supply and the voltage of the driving power after being stepped up has not been reduced below the preset limiter-ON voltage; limiter-ON-voltage detection prohibiting unit or means for prohibiting the detecting operation of the limiter-ON-voltage detector when it is determined, based on a detection result of the power-generation detector, that power is not generated by the power generator; and step-up factor changing unit or means for setting the step-up factor n to n' (where n' is a real number and satisfies $1 \leqq n' < n$) when it is determined, based on a detection result of the limiter-ON-voltage detector, that at least one of the voltage generated by the power generator, the voltage accumulated in the power supply and the voltage of the driving power after being stepped up has not been reduced below the preset limiter-ON voltage, and also when the source-voltage stepping-up unit is performing step-up operation.

Also, the step-up factor changing unit may include a time-lapse determining unit or means for determining whether or not a predetermined factor-change prohibiting time, set in advance, has lapsed from the timing at which the step-up factor N was changed to N'; and a change prohibiting unit or means for prohibiting a change of the step-up factor until the predetermined factor-change prohibiting time, set in advance, lapses from the timing at which the step-up factor N was changed to N'.

Also, according to the present invention, a portable electronic device comprises a power generator or generating means for generating power through conversion from first energy to second energy in the form of electrical energy; a power supply or means for accumulating the electrical energy produced by the power generator; a source-voltage stepping-up/down unit or means for stepping up or down a voltage of the electrical energy supplied from the power supply at a step-up/down factor n (when n is a positive real number) and supplying the stepped-up/down voltage as driving power; a driven unit or means driven with the driving power supplied from the source-voltage stepping-up/down unit; a power-generation detector or detecting means for detecting whether or not power is generated by the power generator; a limiter-ON-voltage detector or detecting means for detecting whether or not at least one of a voltage generated by the power generator, a voltage accumulated in the power supply and a voltage of the driving power after being stepped up or down exceeds a preset limiter-ON voltage; a limiter or limiter means for limiting the voltage of the electrical energy to be supplied to the power supply to a predetermined reference voltage, set in advance, when it is determined, based on a detection result of the limiter-ON-voltage detector that at least one of the voltage generated by the power generator, the voltage accumulated in the power supply and the voltage of the driving power after being stepped up or down has not been reduced below the preset limiter-ON voltage; a limiter-ON-voltage detection prohibiting unit or means for prohibiting the detecting operation of the limiter-ON-voltage detector when it is determined, based on a detection result of the power-generation detector, that power is not generated by the power generator; and a step-up/down factor changing unit or means for setting the step-up factor n to n' (where n' is a positive real number and satisfies $n' < n$) when it is determined, based on a detection result of the limiter-ON-voltage detector, that at least one of the voltage generated by the power generator, the voltage accumulated in the power supply and the voltage of the driving power after being stepped up or down is not lower than the preset limiter-ON voltage.

According to another aspect of the invention, the step-up/down factor changing includes a time-lapse determining unit or means for determining whether or not a predetermined factor-change prohibiting time, set in advance, has lapsed from the timing at which the step-up/down factor N was changed to N'; and a change prohibiting unit or means for prohibiting a change of the step-up/down factor until the predetermined factor-change prohibiting time set in advance lapses from the timing at which the step-up/down factor N was changed to N'.

According to another aspect of the invention, the source-voltage stepping-up/down unit has a number M (M is an integer not less than 2) of step-up/down capacitors for step-up/down operation; and in the step-up/down operation, a number L (where L is an integer not less than 2 but not more than M) of ones among the number M of step-up/down capacitors are connected in series to be charged with the electrical energy supplied from the power supply, and the number L of step-up/down capacitors are then connected in parallel to produce a voltage lower than the electrical energy supplied from the power supply, the produced lower voltage being used as a voltage after the step-down operation or as a part of a voltage after the step-up operation.

According to another aspect of the invention, the portable electronic device further comprises a limiter controller or control means for bringing the limiter into an inoperative state when power is not generated by the power generator.

According to another aspect of the invention, the portable electronic device further comprises a limiter controller or control means for bringing the limiter into an inoperative state when an operating mode of the portable electronic device is in a power-saving mode.

According to another aspect, the power-generation detector detects whether or not power is generated, in accordance with a level of the generated voltage and a duration of power generation by the power generator.

According to another aspect of the present invention, a portable electronic device comprises a power generator or generating means for generating power through conversion from first energy to second energy in the form of electrical energy; a power supply or power supply means for accumulating the electrical energy produced by the power generation; a driven unit or means driven with the electrical energy supplied from the power supply; a power-generation detector or detecting means for detecting whether or not power is generated by the power generator; a limiter-ON-voltage detector or detecting means for detecting whether or not a voltage generated by the power generator or a voltage accumulated in the power supply exceeds a preset limiter-ON voltage; a limiter or limiter means for limiting the voltage of the electrical energy to be supplied to the power supply to a predetermined reference voltage, set in advance, when it is determined based on a detection result of the limiter-ON-voltage detector that the voltage generated by the power generator or the voltage accumulated in the power supply has not been lowered below the preset limiter-ON voltage, and a limiter controller or control means for bringing the limiter means into an inoperative state when power is not generated.

According to another aspect of the present invention, a portable electronic device comprises a power generator or generating means for generating power through conversion from first energy to second energy in the form of electrical energy; a power supply or power supply means for accumulating the electrical energy produced by the power generation; a source-voltage transforming unit or means for transforming a voltage of the electrical energy supplied from the power supply means and supplying the transformed voltage as driving power; a driven unit or means driven with the driving power supplied from the source-voltage transforming unit; a transformation prohibiting unit or means for prohibiting operation of the source-voltage transforming when the voltage of the power supply is lower than a predetermined voltage, set in advance, and also when the amount of power generated by the power generator is smaller than a predetermined amount of power set in advance; an accumulated-voltage detector or detecting means for detecting a voltage during or after voltage accumulation in the power supply when the operation of the source-voltage transforming is unit prohibited; and a transforming factor control unit or means for setting, in accordance with the voltage during or after the voltage accumulation in the power supply, a transforming factor used after the operation-prohibited state of the source-voltage transforming unit is released.

According to another aspect, the driven unit includes a time-measuring unit or means for indicating the time of day.

According to another aspect of the present invention, for an portable electronic device comprising a power generating device for generating power through conversion from first energy to second energy in the form of electrical energy, a power supply device for accumulating the electrical energy produced by the power generation, and a driven device driven with the electrical energy supplied, from the power supply device, a control method comprises a power-generation detecting step of detecting whether or not power is generated by the power generating device; a limiter-ON-voltage detecting step of detecting whether or not a voltage generated by the power generating device or a voltage accumulated in the power supply device exceeds a preset limiter-ON voltage; a limiting step of limiting the voltage of the electrical energy to be supplied to the power supply device to a predetermined reference voltage set in advance when it is determined, based on a detection result in the limiter-ON-voltage detecting step, that the voltage generated by the power generating device or the voltage accumulated in the power supply device has not been reduced below the preset limiter-ON voltage; and a limiter-ON-voltage detection prohibiting step of prohibiting the detecting operation in the limiter-ON-voltage detecting step when it is determined, based on a detection result in the power-generation detecting step, that power is not generated by the power generating device.

In a further aspect of the invention, in a control method for a portable electronic device comprising a power generating device for generating power through conversion from first energy to second energy in the form of electrical energy, a power supply device for accumulating the electrical energy produced by the power generation, a source-voltage stepping-up device for stepping up a voltage of the electrical energy supplied from the power supply device at a step-up factor N (where N is a real number larger than 1) and supplying the stepped-up voltage as driving power, and a driven device driven with the driving power supplied from the source-voltage stepping-up device, the method comprises a power-generation detecting step of detecting whether or not power is generated by the power generating device; a limiter-ON-voltage detecting step of detecting whether or not at least one of a voltage generated by the power generating device, a voltage accumulated in the power supply device and a voltage of the driving power after being stepped up exceeds a preset limiter-ON voltage; a limiting step of limiting the voltage of the electrical energy to be supplied to the power supply device to a predetermined reference voltage, set in advance, when it is determined based on a detection result in the limiter-ON-voltage detecting step that at least one of the voltage generated by the power generating device, the voltage accumulated in the power supply device and the voltage of the driving power after being stepped up has not been reduced below the preset limiter-ON voltage; a limiter-ON-voltage detection prohibiting step of prohibiting the detecting operation in the limiter-ON-voltage detecting step when it is determined, based on a detection result in the power-generation detecting step, that power is not generated by the power generating device; and a step-up factor changing step of setting the step-up factor N to N' (where N' is a real number and satisfies $1 \leqq N' < N$) when it is determined based on a detection result in the limiter-ON-voltage detecting step that at least one of the voltage generated by the power generating device, the voltage accumulated in the power supply device and the voltage of the driving power after being stepped up has not been reduced below the preset limiter-ON voltage, and also when the source-voltage stepping-up device is performing a step-up operation.

In another aspect, in a control method for a portable electronic device comprising a power generating device for generating power through conversion from first energy to second energy in the form of electrical energy, a power supply device for accumulating the electrical energy produced by the power generation, a source-voltage stepping-up/down device for stepping up or down a voltage of the electrical energy supplied from the power supply device at a step-up factor n (where n is a positive real number) and supplying the stepped-up/down voltage as driving power, a driven device driven with the driving power supplied from the source-voltage stepping-up/down device, and a power-generation detecting device for detecting whether or not power is generated by the power generating device, the method comprises a limiter-ON-voltage detecting step of detecting whether or not at least one of a voltage generated by the power generating device, a voltage accumulated in the power supply device and a voltage of the driving power after being stepped up or down exceeds a preset limiter-ON voltage; a limiting step of limiting the voltage of the electrical energy to be supplied to the power supply device to a predetermined reference voltage set in advance when it is determined based on a detection result in the limiter-ON-voltage detecting step that at least one of the voltage generated by the power generating device, the voltage accumulated in the power supply device and the voltage of the driving power after being stepped up or down has not been reduced below the preset limiter-ON voltage; a limiter-ON-voltage detection prohibiting step of prohibiting the detecting operation in the limiter-ON-voltage detecting step when it is determined based on a detection result of the power-generation detecting device that power is not generated by the power generating device; and a step-up/down factor changing step of setting the step-up factor n to n' (where n' is a positive real number and satisfies n'<n) when it is determined based on a detection result in the limiter-ON-voltage detecting step that at least one of the voltage generated by the power generating device, the voltage accumulated in the power supply device and the voltage of the driving power after being stepped up or down has not been reduced below the preset limiter-ON voltage.

In another aspect, in a control method for a portable electronic device comprising a power generating device for generating power through conversion from first energy to second energy in the form of electrical energy, a power supply device for accumulating the electrical energy produced by the power generation, a source-voltage transforming device for transforming a voltage of the electrical energy supplied from the power supply device and supplying the transformed voltage as driving power, and a driven device driven with the driving power supplied from the source-voltage transforming device, the method comprises a transformation prohibiting step of prohibiting operation of the source-voltage transforming device when the voltage of the power supply device is lower than a predetermined voltage set in advance, and also when the amount of power generated by the power generating device is smaller than a predetermined amount of power set in advance; an accumulated-voltage detecting step of detecting a voltage during or after voltage accumulation in the power supply device when the operation of the source-voltage transforming device is prohibited; and a transforming factor control step of setting, in accordance with the voltage during or after the voltage accumulation in the power supply device, a transforming factor used after the operation-prohibited state of the source-voltage transforming device is released.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts:

FIG. 3 is a table for explaining the operation of the voltage step-up/down circuit.

FIG. 8 is a table for explaining the relationship between the status of power generation and the operation of the voltage step-up/down circuit.

FIGS. 14A and 14B are diagrams for explaining examples of a limiter circuit.

FIG. 16 shows a detailed construction of a step-up/down-factor control clock generating circuit.

FIG. 18 is a diagram for explaining the operation of the limiter/step-up/down-factor control circuit.

FIG. 19 is a diagram for explaining step-up/down-factor control clocks.

DESCRIPTION OF THE PREFERRED EMBODIMENTS

Hereinbelow, a preferred embodiment of the present invention is described with reference to the drawings.

[1] General Construction

Figure 1:
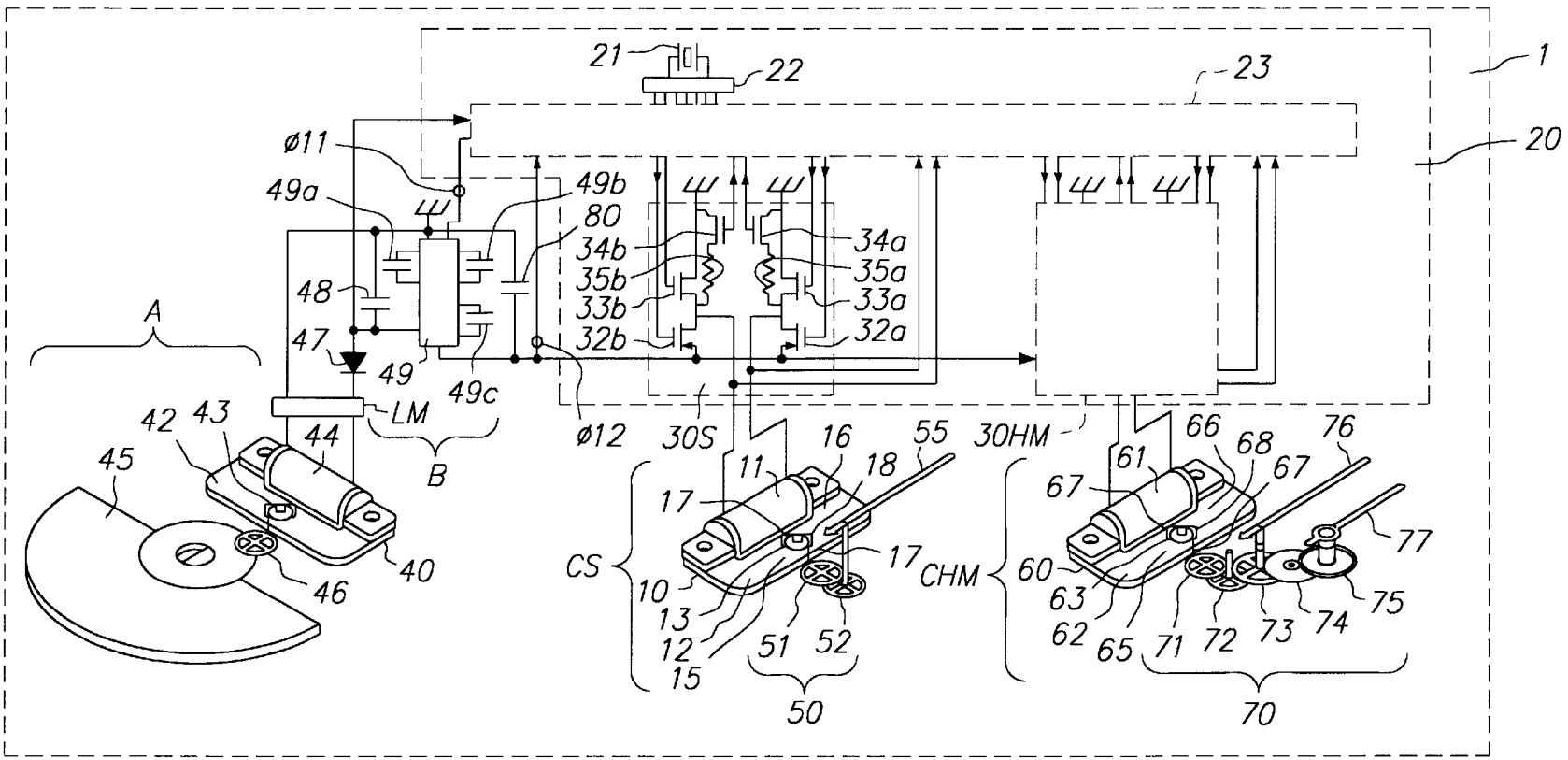
FIG. 1 shows a general construction of a timepiece according to an embodiment present invention.

FIG. 1 shows a general construction of a timepiece 1 according to one embodiment the present invention.

The timepiece 1 is a wristwatch that a user uses by wearing a band connected its body around a wrist of the user.

The timepiece 1 of this embodiment mainly comprise a power generating section A for generating AC power; a power supply section B for rectifying an AC voltage from the power generating section A, accumulating a stepped-up voltage, and supplying power to various components; a control section 23 including a status-of-power-generation detecting section 91 (see FIG. 6) for detecting a status of power generation in the power generating section A, and controlling the entire unit in accordance with the detected result; a second-hand operating mechanism CS for driving a second hand 55 by using a stepping motor 10; a hour/minute-hand operating mechanism CHM for driving hour and minute hands by using a stepping motor; a second-hand driving section 30S for driving the second-hand operating mechanism CS in accordance with a control signal from the control section 23; a hour/minute-hand driving section 30HM for driving the hour/minute-hand operating mechanism CHM in accordance with a control signal from the control section 23; and an external input unit 100 (see FIG. 6) for instructing an operation mode of the timepiece 1 to be shifted from a time-indicating mode to one of a calendar-correcting mode and a time-correcting mode, or forcibly to a power-saving mode (described later).

Depending on the status of power generation in the power generating section A, the control section 23 switches the operation mode between the indicating mode (normal operation mode) in which the hand operating mechanisms CS and CHM are driven to indicate the time of day, and the power-saving mode in which power supply to one or both of the second-hand operating mechanism CS and the hour/minute-hand operating mechanism CHM is discontinued to save power. The mode is forced to switch back to the indicating mode from the power-saving mode when the user holds the timepiece 1 in his or her hand and swings it to forcibly generate power and a predetermined generated voltage is detected.

[2] Detailed Construction

Hereinbelow, a description will be given of the individual components of the timepiece 1. A description of the control section 23 will be separately given later.

[2.1] Power Generating Section

First, a description will be given of the power generating section A.

The power generating section A comprises a power generator 40, a rotating weight 45, and a speed-up wheel 46.

The power generator 40 comprises an AC power generator of the electromagnetic induction type in which a power generation rotor 43 rotates in a power generation stator 42, and power induced in a power generation coil 44 connected to the power generation stator 42 can be output from the generator.

The rotating weight 45 functions to transmit kinetic energy to the power generation rotor 43. The movement of the rotating weight 45 is transmitted to the power generation rotor 43 via the speed-up wheel 46.

In the timepiece 1 of the wristwatch type, the rotating weight 45 can rotate within the timepiece according to, for example, the movement of an arm of the user. Thus, by making use of energy created through normal action of the user, the rotating weight 45 can generate electrical power and drive the timepiece 1 with the generated electrical power.

[2.2] Power Supply Section

Next, a description will be given of the power supply section B.

The power supply section B comprises a limiter circuit LM for preventing an overvoltage from being applied to downstream circuits, a diode 47 functioning as a rectifying circuit, a large-capacitance secondary power supply (capacitor) 48, a voltage step-up/down circuit 49, and an auxiliary capacitor 80. The circuits may be arranged as shown in FIG. 1, in the order of the limiter circuit LM, the rectifying circuit (diode 47), and the large-capacitance capacitor 48 from the side of the generating section A. However, they may also be arranged in the order of the rectifying circuit (diode 47), the limiter circuit LM, and the large-capacitance capacitor 48.

The voltage step-up/down circuit 49 can step up and down voltage in multiple steps by using capacitors 49*a* and 49*b*. A detailed description of the voltage step-up/down circuit 49 will be separately given below.

The power stepped up or down in voltage by the voltage step-up/down circuit 49 is accumulated in the auxiliary capacitor 80.

In this case, the voltage step-up/down circuit 49 can adjust voltage to be supplied to the auxiliary capacitor 80 in accordance with a control signal ϕ11 from the control section 23, and in addition, can adjust voltages to be supplied to the second-hand driving section 30S and the hour/minute-hand driving section 30HM.

The power supply section B uses Vdd (high-voltage side) as a reference potential (GND), and produces Vss (low-voltage side) as a power-supply voltage.

Hereinbelow, the limiter circuit LM is described.

The limiter circuit LM functions equivalently as a switch for short-circuiting the power generating section A, and turns ON (closed) when a generated voltage VGEN of the power generating section A exceeds a predetermined limit-reference voltage VLM.

Upon turning-ON of the limiter circuit LM, the power generating section A is electrically disconnected from the large-capacitance secondary power supply 48.

As a result, an excessively high generated voltage VGEN is prevented from being applied to the large-capacitance secondary power supply 48, and the large-capacitance secondary power supply 48, and hence the timepiece 1 can be prevented from being damaged due to application of the generated voltage VGEN exceeding the voltage tolerance of the large-capacitance secondary power supply.

Hereinbelow, the voltage step-up/down circuit 49 is described with reference to FIGS. 2 to 5.

Figure 2:
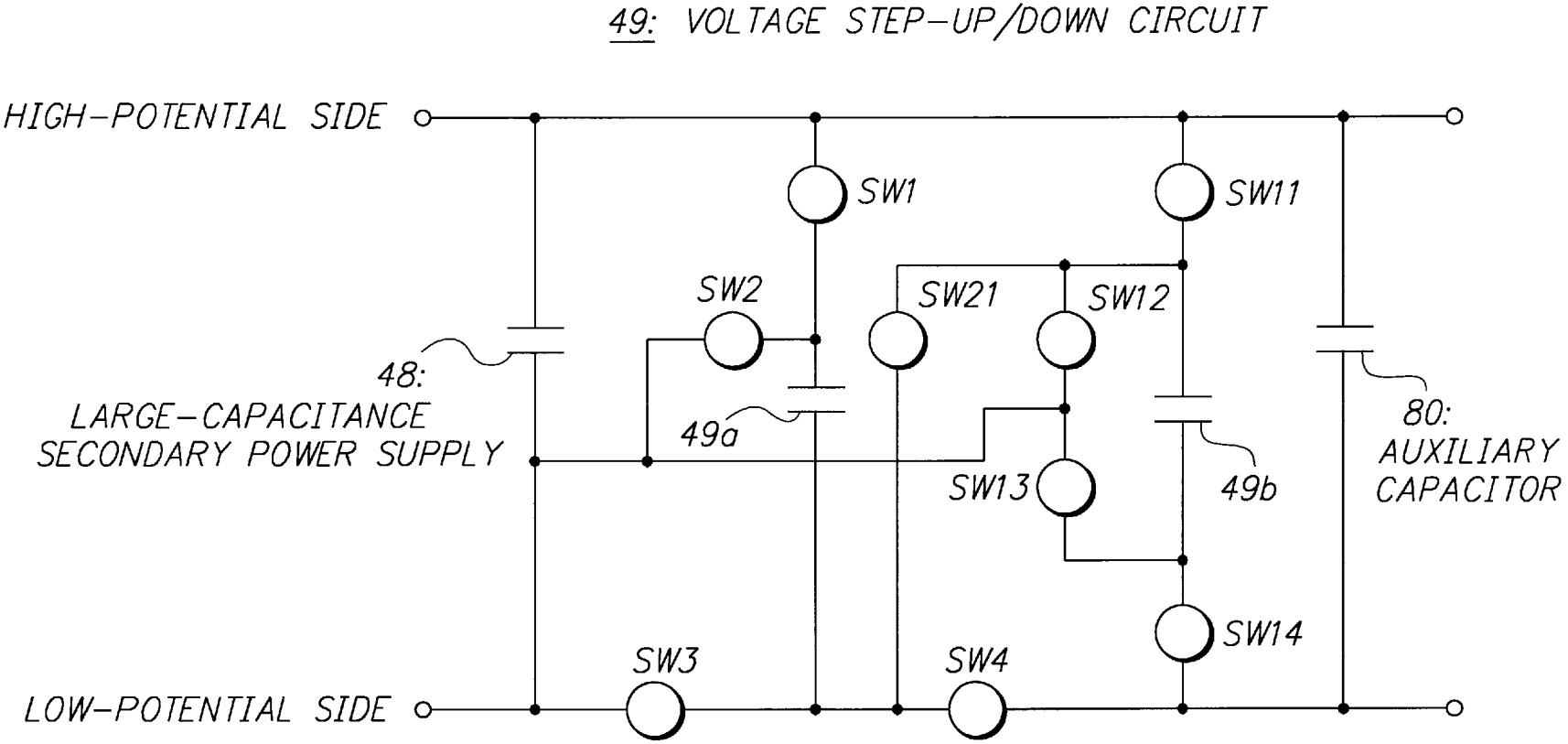
FIG. 2 shows a general construction of a voltage step-up/down circuit.

As shown in FIG. 2, the voltage step-up/down circuit 49 is made up of a switch SW1, a switch SW2, the capacitor 49*a*, a switch SW3, a switch SW4, a switch SW11, a switch SW12, the capacitor 49*b*, a switch SW13, a switch SW14, and a switch SW21. More specifically, one terminal of the switch SW1 is connected to a high-potential-side terminal of the large-capacitance secondary power supply 48. One terminal of the switch SW2 is connected to the other terminal of the switch SW1, and the other terminal thereof is connected to a low-potential-side terminal of the large-capacitance secondary power supply 48. One terminal of the capacitor 49*a* is connected to a point connecting the switch SW1 and the switch SW2. One terminal of the switch SW3 is connected to the other terminal of the capacitor 49*a*, and the other terminal thereof is connected to the low-potential-side terminal of the large-capacitance secondary power supply 48. One terminal of the switch SW4 is connected to a low-potential-side terminal of the auxiliary capacitor 80, and the other terminal thereof is connected to a point connecting the capacitor 49*a* and the switch SW3. One terminal of the switch SW11 is connected to a point connecting the high-potential-side terminal of the large-capacitance secondary power supply 48 and a high-potential-side terminal of the auxiliary capacitor 80. One terminal of the switch SW12 is connected to the other terminal of the switch SW11, and the other terminal thereof is connected to the low-potential-side terminal of the large-capacitance secondary power supply 48. One terminal of the capacitor 49*b* is connected to a point connecting the switch SW11 and the switch SW12. One terminal of the switch SW13 is connected to the other terminal of the capacitor 49*b*, and the other terminal thereof is connected to a point connecting the switch SW12 and the low-potential-side terminal of the large-capacitance secondary power supply 48. One terminal of the switch SW14 is connected to a point connecting the capacitor 49*b* and the switch SW13, and the other terminal thereof is connected to the low-potential-side terminal of the auxiliary capacitor 80. One terminal of the switch SW21 is connected to a point connecting the switch SW11 and the switch SW12, and the other terminal thereof is connected to a point connecting the capacitor 49*a* and the switch SW3.

Hereinbelow, with reference to FIGS. 3 to 5, the operation of the voltage step-up/down circuit is briefly described taking as examples the cases of 3-times step-up and ½-time step-down.

The voltage step-up/down circuit 49 operates in accordance with predetermined voltage step-up/down clocks (not shown). In the 3-times step-up case, as shown in FIG. 3, at the timing of a first step-up/down clock (at the timing of parallel connection), the voltage step-up/down circuit 49 turns ON the switch SW1, turns OFF the switch SW2, turns ON the switch SW3, turns OFF the switch SW4, turns ON the switch SW11, turns OFF the switch SW12, turns ON the switch SW13, turns OFF the switch SW14, and turns OFF the switch SW21.

Figure 4:
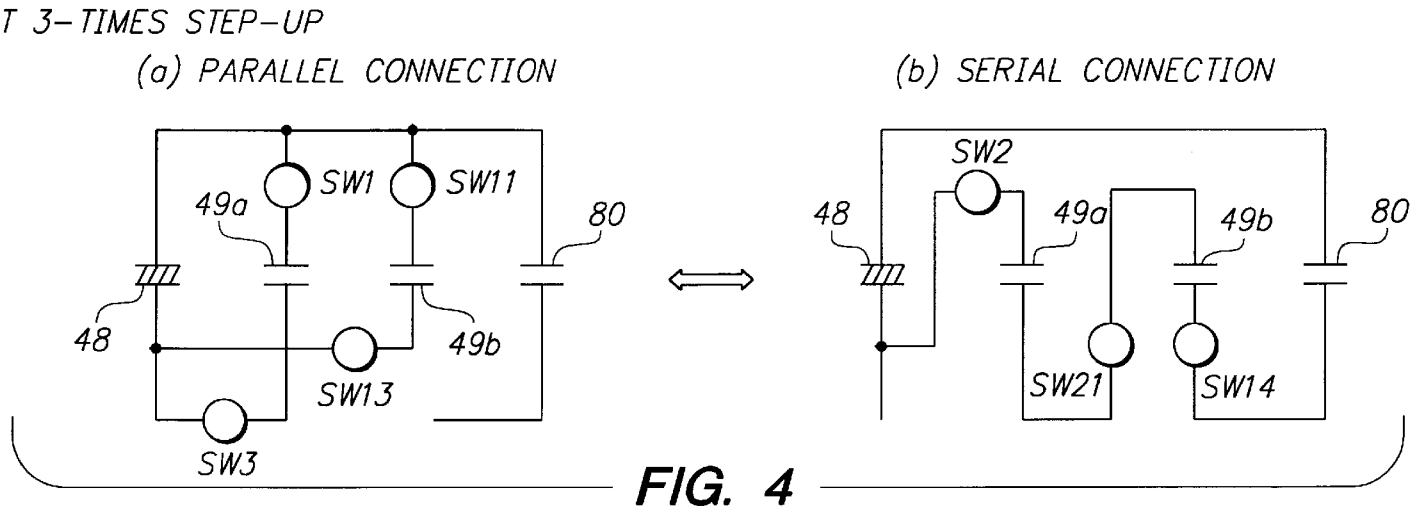
FIG. 4 shows an equivalent circuit at 3-times step-up.

In this case, an equivalent circuit of the voltage step-up/down circuit 49 is as shown in FIG. 4, part (a). Power is supplied from the large-capacitance secondary power supply 48 to the capacitor 49*a* and the capacitor 49*b*, whereby charging is continued until voltages of the capacitor 49*a* and the capacitor 49*b* become substantially equal to the voltage of the large-capacitance secondary power supply 48.

Then, at the timing of a second step-up/down clock (at the timing of serial connection), the circuit turns OFF the switch SW1, turns ON the switch SW2, turns OFF the switch SW3, turns OFF the switch SW4, turns OFF the switch SW11, turns OFF the switch SW12, turns OFF the switch SW13, turns ON the switch SW14, and turns ON the switch SW21.

In this case, an equivalent circuit of the voltage step-up/down circuit 49 is as shown in FIG. 4, part (b). The large-capacitance secondary power supply 48, the capacitor 49*a*, and the capacitor 49*b* are connected in series, and the auxiliary capacitor 80 is charged with a voltage which is three times that of the large-capacitance secondary power supply 48. Thus 3-times step-up is realized.

In the ½-time step-down case, as shown in FIG. 3, at the timing of the first step-up/down clock (at the timing of parallel connection), the circuit turns ON the switch SW1, turns OFF the switch SW2, turns OFF the switch SW3, turns OFF the switch SW4, turns OFF the switch SW11, turns OFF the switch SW12, turns ON the switch SW13, turns OFF the switch SW14, and turns ON the switch SW21.

Figure 5:
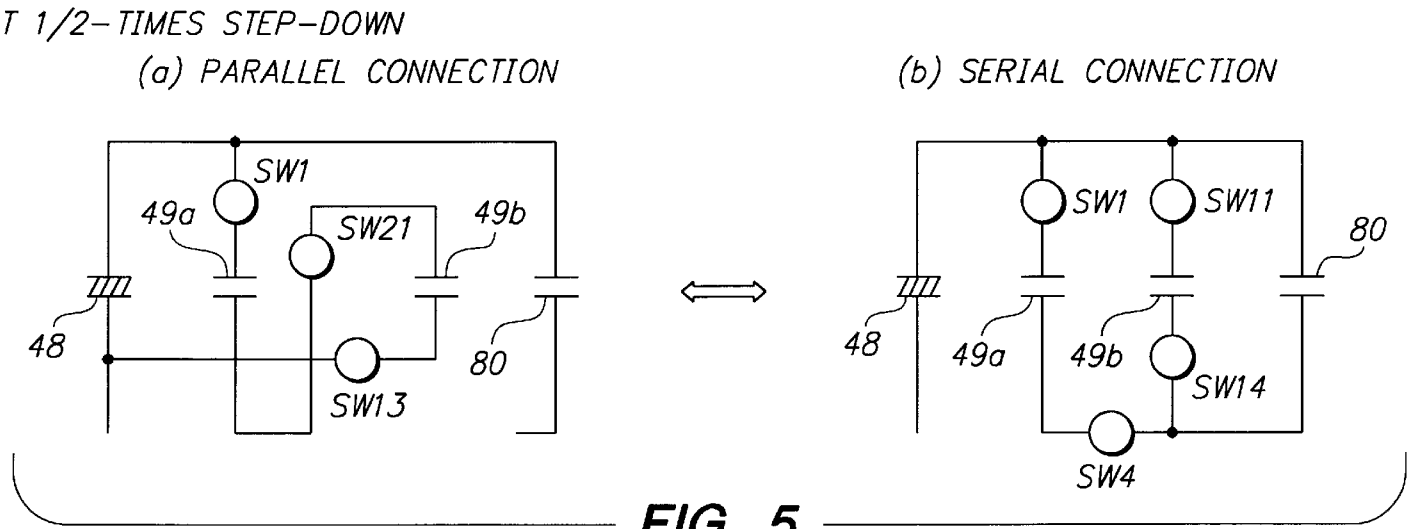
FIG. 5 shows an equivalent circuit at ½-time step-down.

In this case, an equivalent circuit of the voltage step-up/down circuit 49 is as shown in FIG. 5, part (a). Power is supplied from the large-capacitance secondary power supply 48 to the capacitor 49*a* and the capacitor 49*b* which are connected in series. When capacitance values of the capacitor 49*a* and the capacitor 49*b* are the same, charging is continued until respective voltages of the capacitors 49*a* and 49*b* become substantially ½ of the voltage of the large-capacitance secondary power supply 48.

Then, at the timing of the second step-up/down clock timing (at the timing of serial connection), the circuit turns ON the switch SW1, turns OFF the switch SW2, turns OFF the switch SW3, turns ON the switch SW4, turns ON the switch SW11, turns OFF the switch SW12, turns OFF the switch SW13, turns ON the switch SW14, and turns OFF the switch SW21.

In this case, an equivalent circuit of the voltage step-up/down circuit 49 is as shown in FIG. 5, part (b). The capacitor 49*a* and the capacitor 49*b* are connected in parallel, and the auxiliary capacitor 80 is charged with a voltage which is ½ that of the large-capacitance secondary power supply 48. Thus ½-time step-down is realized.

Similarly, voltage step-up/down is implemented in the cases of 2-times step-up, 1.5-times step-up, and no step-up (step-up factor=1).

[2.3] Hand Operating Mechanisms

Next, a description will be given of the hand operating mechanisms CS and CHM.

[2.3.1] Second-hand Operating Mechanism

First, the second-hand operating mechanism CS is described below.

The stepping motor 10 used in the second-hand operating mechanism CS is also called a pulse motor, a stepper motor, a step-driving motor, or a digital motor, and is frequently used as an actuator for digital control devices. This motor is driven by pulse signals. Recently, miniaturized and light stepping motors are frequently used as actuators for electronic devices or information-processing apparatuses which are miniaturized to be suitable for carrying with users. Typical examples of those electronic devices include timepieces such as electronic watches, time switches and chronographs.

The stepping motor 10 in this embodiment comprises a drive coil 11 for generating a magnetic force in accordance with a driving pulse supplied from the second-hand driving section 30S, a stator 12 magnetically excited by the drive coil 11, and a rotor 13 that rotates under a magnetic field excited in the stator 12.

The rotor 13 of the stepping motor 10 is of the PM type (permanent-magnet rotating type) having a disc-like double-pole permanent magnet.

The stator 12 has a magnetic-saturating section 17 so as to cause different magnetic poles on phases (poles) 15 and 16 around the rotor 13 by a magnetic force generated in the drive coil 11.

Also, to regulate the rotating direction of the rotor 13, an internal notch 18 is provided at an appropriate position along an internal periphery of the stator 12, whereby cogging torque is generated so as to stop the rotor 13 at the appropriate position.

Rotation of the rotor 13 of the stepping motor 10 is transmitted to a second hand 53 via a wheel train 50 consisting of an intermediate second wheel 51, which is meshed with the rotor 13 via a pinion, and a second wheel 52 (second indicator), thereby indicating seconds.

[2.3.2] Hour/minute-hand Operating Mechanism

Hereinbelow, a description will be given of the hour/minute-hand operating mechanism CHM.

A stepping motor 60 used in the hour/minute-hand operating mechanism CHM has a construction similar to that of the stepping motor 10.

The stepping motor 60 in this embodiment comprises a drive coil 61 for generating a magnetic force in accordance with a driving pulse supplied from the hour/minute-hand driving section 3OHM, a stator 62 magnetically excited by the drive coil 61, and a rotor 63 that rotates under a magnetic field excited in the stator 62.

The rotor 63 of the stepping motor 60 is of the PM type (permanent-magnet rotating type) having a disc-like double-pole permanent magnet. The stator 62 has a magnetic-saturating section 67 so as to cause different magnetic poles on phases (poles) 65 and 66 around the rotor 63 by a magnetic force generated in the drive coil 61. Also, to regulate the rotating direction of the rotor 63, an internal notch 68 is provided at an appropriate position along an internal periphery of the stator 62, whereby cogging torque is generated so as to stop the rotor 63 at the appropriate position.

Rotation of the rotor 63 of the stepping motor 60 is transmitted to individual hands via a wheel train 70 consisting of a 4th (second) wheel 71, which is meshed with the rotor 63 via a pinion, a 3rd wheel 72, a 2nd (center) wheel (minute-indicating wheel) 73, a minute wheel 74, and a hour wheel (hour-indicating wheel) 75. In addition, a minute hand 76 is connected to the 2nd wheel 73, and an hour hand 77 is connected to the hour wheel 75. These hands 76 and 77 move in conjunction with rotation of the rotor 63 and indicate hours and minutes.

Though not shown, as a matter of course, the wheel train 70 may also be connected to a transmission system for indicating years, months, and dates (calendar), etc. (for example, an hour intermediate wheel, an intermediate date wheel, a date indicator driving wheel, and a date indicator). In this case, the wheel train may further include a calendar-correcting wheel train (for example, a first calendar-correction transmitting wheel, a second calendar-correction transmitting wheel, a calendar-correcting wheel, and a date indicator).

[2.4] Second-hand Driving Section and Hour/minute-hand

Driving Section

Hereinbelow, a description will be given of the second-hand driving section 30S and the hour/minute-hand driving section 30HM. Since the second-hand driving section 30S and the hour/minute-hand driving section 30HM are of a similar construction in this embodiment, only the second-hand driving section 30S is described here.

The second-hand driving section 30S supplies various driving pulses to the stepping motor 10 under control of the control section 23.

The second-hand driving section 30S has a bridge circuit made up of p-channel MOS 33*a* and an n-channel MOS 32*a* connected in series, a p-channel MOS 33*b*, and an n-channel MOS 32*b*.

Also, the second-hand driving section 30S has rotation detecting resistors 35*a* and 35*b* connected respectively to the p-channel MOSs 33*a* and 33*b* in parallel, and has p-channel MOSs 34*a* and 34*b* for making sampling to supply chopper pulses to the rotation detecting resistors 35*a* and 35*b*. By applying control pulses, which are different in polarity and width from each other, to gate electrodes of the MOSs 32*a*, 32*b*, 33*a*, 33*b*, 34*b* and 34*b* at respective proper timings from the control section 23, the driving section can supply, to the drive coil 11, driving pulses differing in polarity from each other or detecting pulses for inducing voltages to detect rotation of the rotor 13 and magnetic fields.

[2.5] Control Circuit

Hereinbelow, with reference to FIGS. 6 and 7, a construction of the control section 23 is described.

Figure 6:
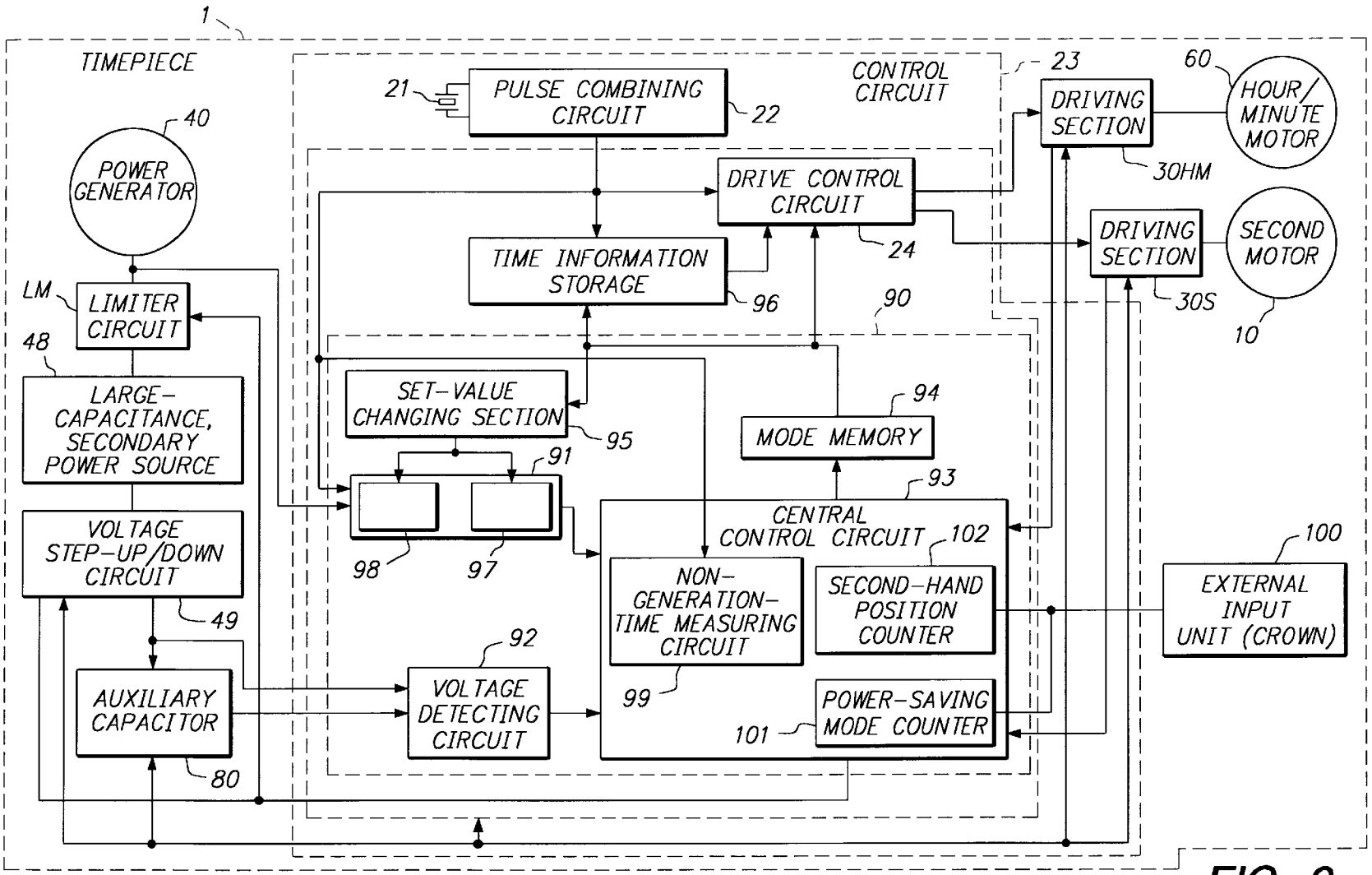
FIG. 6 is a block diagram showing a general construction of a control section and related components in the embodiment of the present invention.
Figure 7:
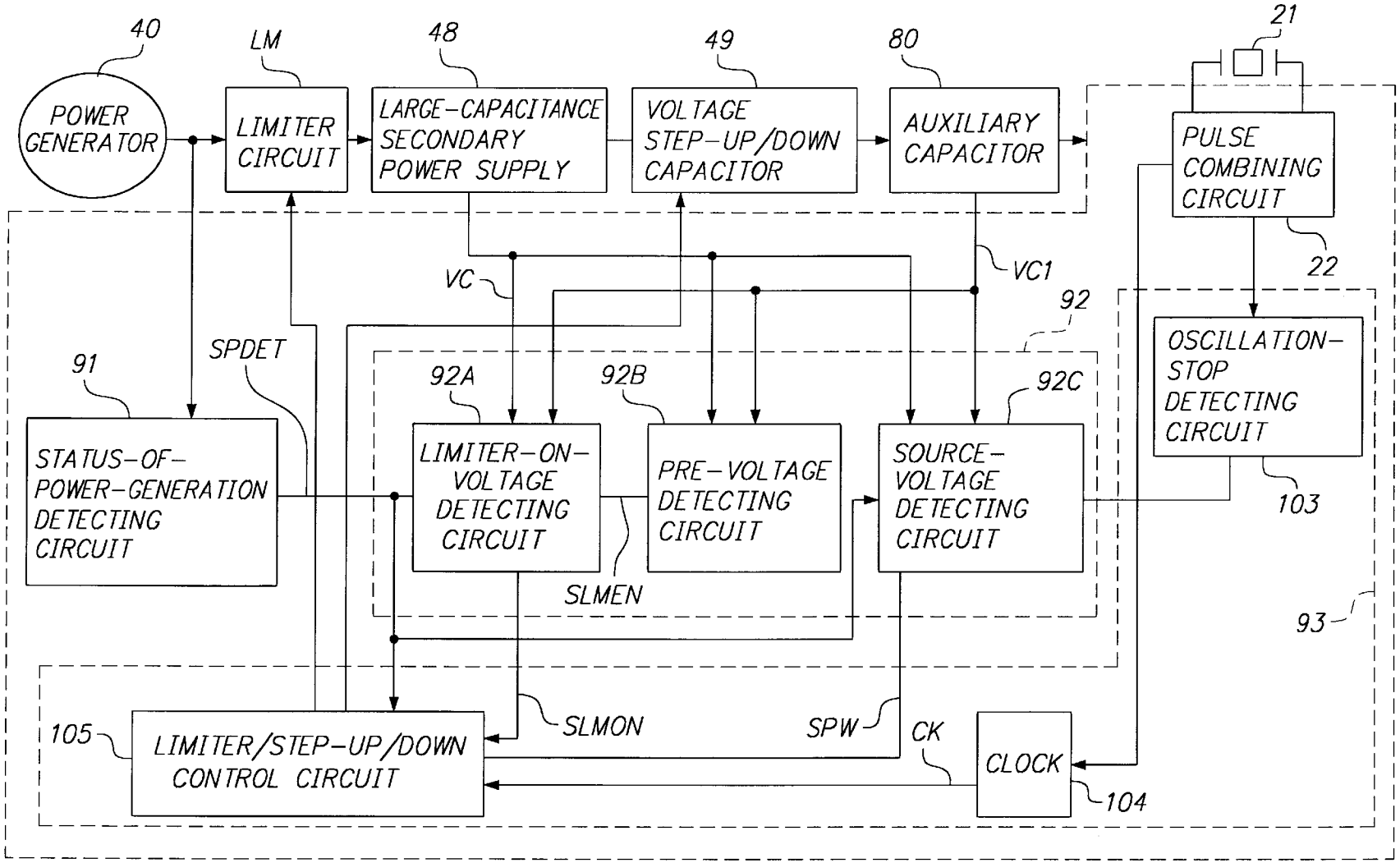
FIG. 7 is a block diagram showing a detailed construction of the principal components of the control section and related components in the embodiment of the present invention.

FIG. 6 is a block diagram showing a general construction of the control section 23 and thereabout (including the power supply section), and FIG. 7 is a block diagram of principal sections in FIG. 6.

The control section 23 mainly comprises a pulse combining circuit 22, a mode setting section 90, a time information storage 96, and a drive control circuit 24.

First, the pulse combining circuit 22 comprises an oscillating circuit and a combining circuit. The oscillating circuit 22 oscillates a reference pulse having a stable frequency by using a reference oscillation source 21 such as a quartz-crystal oscillator. The combining circuit combines frequency-divided pulses obtained by dividing the frequency of the reference pulse with the reference pulse to generate pulse signals differing from each other in pulse width and timing.

The mode setting section 90 comprises a status-of-power-generation detecting section 91; a set-value changing section 95 for changing a set value used to detect the status of power generation; a voltage detecting circuit 92 for detecting a charge voltage VC of the large-capacitance secondary power supply 48 and an output voltage of the voltage step-up/down circuit 49; a central control circuit 93 for controlling the time-indicating mode in accordance with the status of power generation and controlling a step-up factor in accordance with the charge voltage; and a mode storage or memory 94 for storing modes.

The status-of-power-generation detecting section 91 comprises a first detecting circuit 97 and a second detecting circuit 98. The first detecting circuit 97 determines whether or not power generation has been detected, by comparing an electromotive voltage Vgen of the power generator 40 with a set voltage value Vo. The second detecting circuit 98 determines whether or not power generation has been detected, by comparing, with a set time value To, a generation-continuation time Tgen during which the power generator 40 produces an electromotive voltage Vgen not lower than a set voltage value Vbas that is fairly smaller than the set voltage value Vo. If one of the conditions determined by the first detecting circuit 97 and the second detecting circuit 98 is satisfied, the status-of-power-generation detecting section 91 determines the situation to be in power generation and outputs a status-of-power-generation detection signal SPDET. Here, the set voltage values Vo and Vbas are each a negative voltage with Vdd (=GND) set as a reference, indicating the potential difference from Vdd.

A description will now be given of constructions of the first detecting circuit 97 and the second detecting circuit 98 with reference to FIG. 12.

Figure 12:
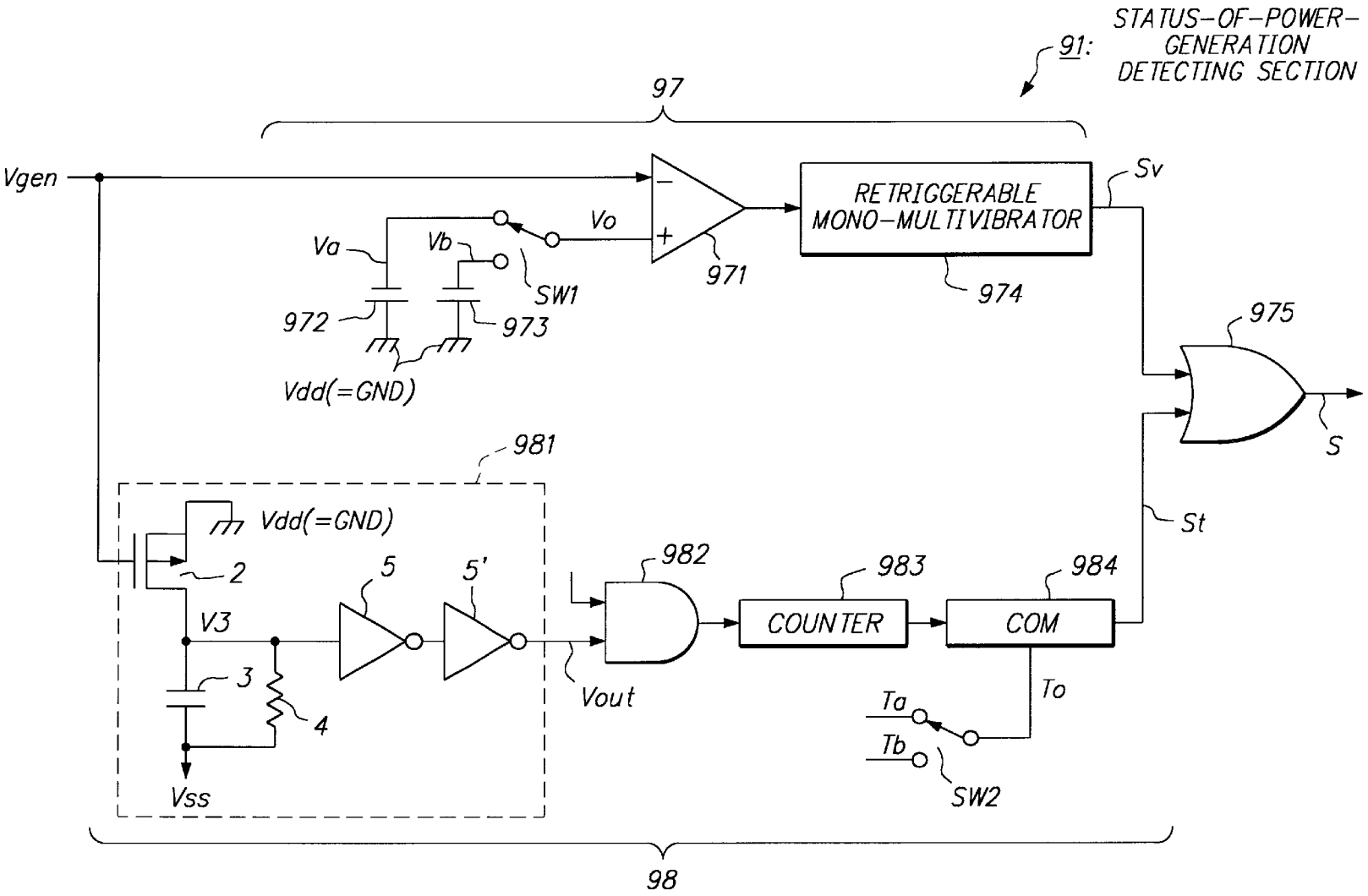
FIG. 12 shows a detailed construction of a status-of-power-generation detecting section.

In FIG. 12, first, the first detecting circuit 97 mainly comprises a comparator 971, a reference voltage source 972 that generates a constant voltage Va, a reference voltage source 973 that generates a constant voltage Vb, a switch SW1, and a retriggerable mono-multivibrator 974.

A voltage value generated by the reference voltage source 972 is set to a voltage value Va to be set in the indicating mode. On the other hand, a voltage value generated by the reference voltage source 973 is set to a voltage value Vb to be set in the power-saving mode. The reference voltage sources 972 and 973 are each connected to a positive input terminal of the comparator 971 via the switch SW1. The switch SW1, which is controlled by the set-value changing section 95, connects the reference voltage source 972 to the positive input terminal of the comparator 971 in the indicating mode, and connects the reference voltage source 973 thereto in the power-saving mode. The electromotive voltage Vgen of the power generating section A is supplied to a negative input terminal of the comparator 971. The comparator 971 therefore compares the electromotive voltage Vgen with the set voltage value Va or the set voltage value Vb, and it generates a comparison-result signal which takes an "H" level if the electromotive voltage Vgen is lower than the set values (i.e., Vgen has a larger negative amplitude) and which takes an "L" level if the electromotive voltage Vgen is higher than the set values (i.e., Vgen has a smaller negative amplitude).

The retriggerable mono-multivibrator 974 generates a signal which is triggered so as to rise from the "L" level to the "H" level at a rising edge occurring when the comparison-result signal rises from the "L" level to the "H" level, and which then falls from the "H" level to the "L" level after the lapse of a predetermined time. If retriggered before the lapse of predetermined time, the mono-multivibrator 974 resets a measured time and starts time measurement anew.

A description will be next given of operation of the first detecting circuit 97.

If the current mode is the indicating mode, the switch SW1 selects the reference voltage source 972 and supplies the set voltage value Va to the comparator 971. In response, the comparator 971 compares the set voltage value Va and the electromotive voltage Vgen and generates a comparison-result signal. In this case, a voltage detection signal Sv from the mono-multivibrator 974 rises from the "L" level to the "H," level in synchronization with the rising edge of the comparison-result signal.

In contrast, if the current mode is the power-saving mode, the switch SW1 selects the reference voltage source 973 and supplies the set voltage value Vb to the comparator 971. In this case, since the electromotive voltage Vgen does not exceed the set voltage value Vb, no trigger is inputted to the mono-multivibrator 974. Accordingly, the voltage detection signal Sv is held at a low level.

In this manner, the first detecting circuit 97 compares the electromotive voltage Vgen to the set voltage value Va or Vb corresponding to the mode, thereby generating the voltage detection signal Sv.

In FIG. 12, the second detecting circuit 98 comprises an integrating circuit 981, a gate 982, a counter 983, a digital comparator 984, and a switch SW2.

First, the integrating circuit 981 is made up of a MOS transistor 2, a capacitor 3, a pull-up resistor 4, an inverter circuit 5, and an inverter circuit 5'.

The electromotive voltage Vgen is connected to the gate of the MOS transistor 2, and the MOS transistor 2 repeats ON/OFF operations in accordance with the electromotive voltage Vgen, thereby controlling charging of the capacitor 3. When a switch is constructed of MOS transistors, the integrating circuit 981 including the inverter circuit 5 can be formed of an inexpensive CMOS-IC. However, these switching devices and voltage detecting circuits may be constructed of bipolar transistors. The pull-up resistor 4 serves to fix a voltage value V3 of the capacitor 3 at the potential Vss during a period in which power is not generated, and concurrently, to generate a leakage current during the non-generation period. The pull-up resistor 4 can also be constructed of a MOS transistor having a high resistance value ranging from several tens to several hundreds MΩ and having a high ON-resistance. The voltage value V3 of the capacitor 3 is determined by the inverter circuit 5 connected to the capacitor 3, and a detection signal Vout is outputted after reversing the level of an output from the inverter circuit 5. Here, a threshold of the inverter circuit 5 is set so as to provide a set voltage value Vbas which is fairly smaller than the set voltage value Vo used in the first detecting circuit 97.

The reference signal supplied from the pulse combining circuit 22 and the detection signal Vout are supplied to the gate 982. The counter 983 then counts the reference signal during a period in which the detection signal Vout has a high level. The count value is supplied to one input terminal of the digital comparator 984. Also, the set time value To corresponding to the set time is supplied to the other input terminal of the digital comparator 984. If the current mode is the indicating mode, a set time value Ta is supplied via the switch SW2, and if the current mode is the power-saving mode, a set time value Tb is supplied via the switch SW2. The switch SW2 is controlled by the set-value changing section 95.

In synchronization with a falling edge of the detection signal Vout, the digital comparator 984 outputs the comparison result as a generation-continuation-time detection signal St. The generation-continuation-time detection signal St takes a "H" level when the time exceeds the set time, and it takes an "L" level when the time is less than the set time.

A description will be next given of operation of the second detecting circuit 98. Upon start of AC-power generation by the power generating section A, the power generator 40 generates the electromotive voltage Vgen via the diode 47.

When the power generation has thus started and the voltage value of the electromotive voltage Vgen falls from Vdd to Vss, the MOS transistor 2 turns ON to start charging of the capacitor 3. The potential at V3 is fixed to the Vss side by the pull-up resistor 4 during the non-generation period, but it begins to rise toward the Vdd side with charging of the capacitor 3 after the start of power generation. Subsequently, when the electromotive voltage Vgen rises toward the Vdd side and the MOS transistor 2 turns OFF, charging of the capacitor 3 stops. However, the potential at V3 is held to its value by the capacitor 3.

The operation described above is repeated during the period in which power generation is continued, while the potential is V3 rises up to Vdd and becomes stable thereat. When the potential at V3 rises higher than the threshold of the inverter circuit 5, the detection signal Vout outputted from the inverter circuit 5' shifts from the "L" level to the "H" level, whereby the status of power generation is detected. The response time until the detection of the status of power generation can be optionally set by connecting a current limiting resistor, or by changing the performance of the MOS transistor to adjust the value of a current charged to the capacitor 3, or by changing the capacitance value of the capacitor 3 itself.

When power generation stops, the electromotive voltage Vgen remains stable at the Vdd level, and hence the MOS transistor 2 is kept turned OFF. The voltage at V3 is maintained by the capacitor 3 for some time, but the capacitor 3 is discharged with a small amount of leakage current attributable to the pull-up resistor 4, causing the voltage V3 to be reduced slowly from Vdd toward Vss. When the voltage V3 exceeds below the threshold of the inverter circuit 5, the detection signal Vout outputted from the inverter circuit 5' shifts from the "H" level to the "L" level, whereby the status of non-power-generation is detected. The response time of the detection can be optionally set by changing the resistance value of the pull-up resistor 4 to adjust the leakage current from the capacitor 3.

When the detection signal Vout is subject to gating and passes the gate 982 with the reference signal, the counter 983 counts it. The count value is compared by the digital comparator 984 with the value corresponding to the set time at the timing T1. If a high-level period Tx of the detection signal Vout is longer than the set time value To, the generation-continuation-time detection signal St changes from the "L" level to the "H" level.

A description will now be given of the electromotive voltage Vgen produced at different rotation speeds of the power generation rotor 43 and the detection signal Vout corresponding to the electromotive voltage Vgen.

The voltage level and the cycle (frequency) of the electromotive voltage Vgen vary in accordance with the rotation speed of the power generation rotor 43. That is, the higher the rotation speed, the larger is the amplitude of the electromotive voltage Vgen and the shorter is the cycle thereof. Therefore, the length of an output-holding time (generation-continuation time) of the detection signal Vout changes depending on the rotation speed of the power generation rotor 43, i.e., on the strength of power generated by the power generator 40. Specifically, when the rotation speed of the power generation rotor 43 is low, i.e., when the generated power is small, the output-holding time is ta, whereas when the rotation speed of the power generation rotor 43 is high, i.e., when the generated power is large, the output-holding time is tb. The relationship between the two parameters is ta<tb. In this way, the strength of the power generated by the power generator 40 can be known from the length of the output-holding time of the detection signal Vout.

In this connection, the set voltage value Vo and the set time value To can be selectively controlled by the set-value changing section 95. When the operation mode switches from the indicating mode to the power-saving mode, the set-value changing section 95 changes the set values Vo and To of the first detecting circuit 97 and the second detecting circuit 98 in the status-of-power-generation detecting section 91.

In this embodiment, the set values Va and Ta in the indicating mode are set to be smaller than the set values Vb and Tb in the power-saving mode. Therefore, a larger generation power is required for switching from the power-saving mode to the indicating mode. Here, for effecting the above mode switching, the level of power which can be obtained by wearing the timepiece 1 in an ordinary manner is not sufficient, but it must be at such a high level as obtained when forcibly generated upon the user swinging his or her hand. In other words, the set values Vb and Tb in the power-saving mode are set so as to be able to detect power generation forcibly caused by hand swinging.

Further, the central control circuit 93 has a non-generation-time measuring circuit 99 for measuring non-generation time Tn during which power generation is not detected by the first and second detecting circuits 97 and 98. When the non-generation generation time Tn continues for a longer time than a predetermined set time, the mode switches from the indicating mode to the power-saving mode.

On the other hand, switching from the power-saving mode to the indicating mode is effected when the following two conditions are satisfied; namely, the status-of-power-generation detecting section 91 detects that the power generating section A is in the status of power generation, and the charge voltage VC of the large-capacitance secondary power supply 48 is sufficient.

In this connection, if the limiter circuit LM is in an operable state with the mode switched to the power-saving mode, the limiter circuit LM is forced to turn ON (closed) when the electromotive voltage Vgen of the power generating section A exceeds the predetermined limit-reference voltage VLM.

As a result, the power generating section A is short-circuited and the status-of-power-generation detecting section 91 cannot detect the fact, even if so, that the power generating section A is in the status of power generation. Thus the operation mode fails to switch from the power-saving mode to the indicating mode.

To overcome that problem, is this embodiment, when the operation mode is the power-saving mode, the limiter circuit LM is forced to turn OFF (open) regardless of whether or not the power generating section A is in the status of power generation, thereby enabling the status-of-power-generation detecting section 91 to reliably detect the status of power generation in the power generating section A.

Also, as shown in FIG. 7, the voltage detecting circuit 92 comprises a limiter-ON-voltage detecting circuit 92A, a pre-voltage detecting circuit 92B, and a source-voltage detecting circuit 92C. The limiter-ON-voltage detecting circuit 92A detects whether or not to set the limiter circuit LM in an operative state by comparing the charge voltage VC of the large-capacitance secondary power supply 48 or a charge voltage VC1 of the auxiliary capacitor 80 with a preset limiter-ON reference voltage VLMON generated by a limiter-ON-reference-voltage generating circuit (not shown), and then outputs a limiter-ON signal SLMON. The pre-voltage detecting circuit 92B detects whether or not to set the limiter-ON-voltage detecting circuit 92A in an operative state by comparing the charge voltage VC of the large-capacitance secondary power supply 48 or the charge voltage VC1 of the auxiliary capacitor 80 with a preset limiter-circuit-operation reference voltage VPRE (referred to as a "pre-voltage hereinbelow) generated by a pre-voltage generating circuit (not shown), and then outputs a limiter-operation-permitting signal SLMEN. The source-voltage detecting circuit 92C detects the charge voltage VC of the large-capacitance secondary power supply 48 or the charge voltage VC1 of the auxiliary capacitor 80, and then outputs a source-voltage detection signal SPW.

In this embodiment, the limiter-ON-voltage detecting circuit 92A employs a circuit configuration which can perform voltage detection with higher precision than performed by the pre-voltage detecting circuit 92B. Therefore, the limiter-ON-voltage detecting circuit 92A has larger circuit scale and consumes power in a larger amount as compared with the pre-voltage detecting circuit 92B.

Figure 13:
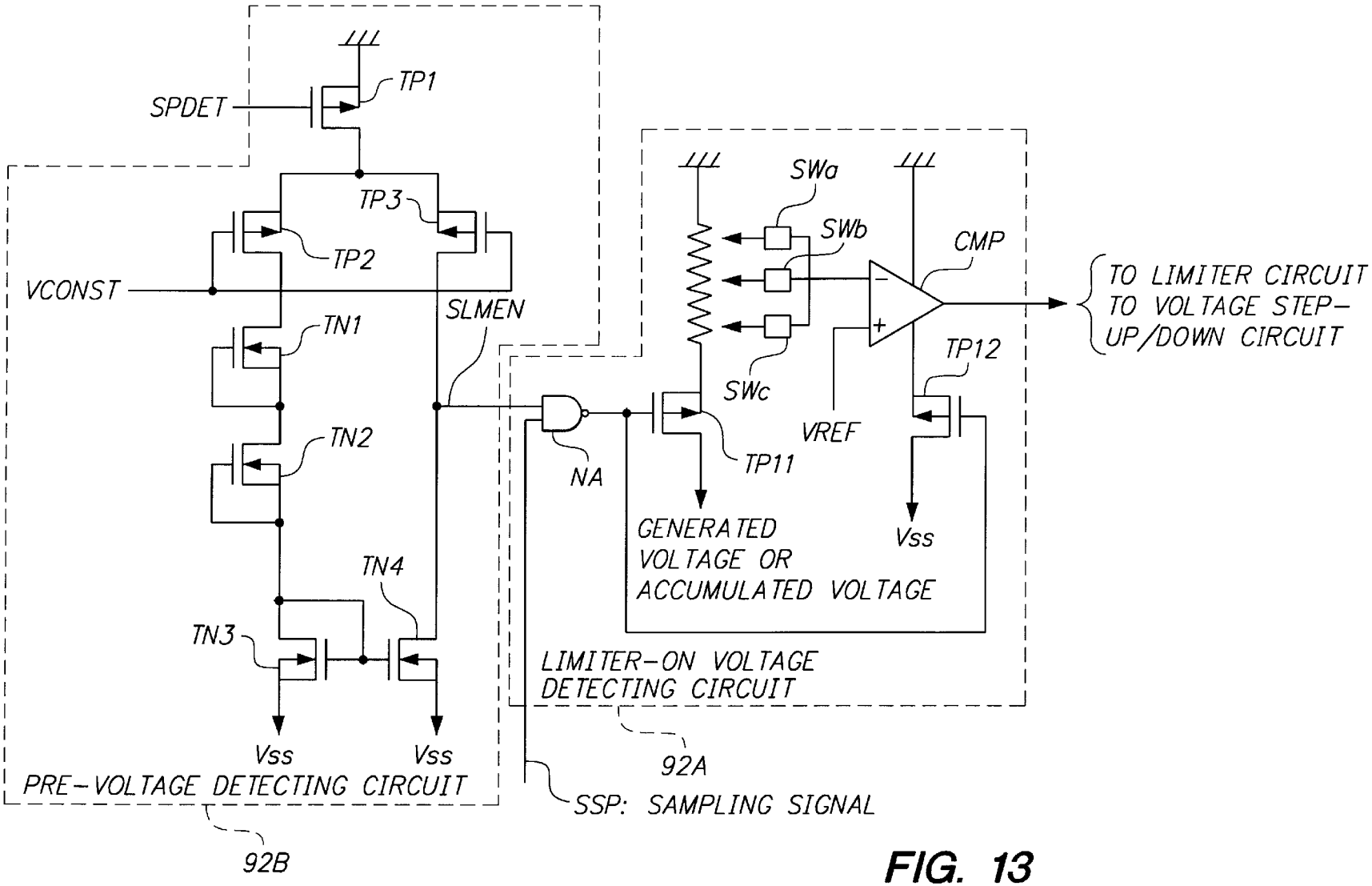
FIG. 13 shows a detailed construction of a limiter-ON voltage detecting circuit and a pre-voltage detecting circuit.

With reference to FIGS. 13 and 14A and 14B, a description will now be given of detailed constructions and operations of the limiter-ON-voltage detecting circuit 92A, the pre-voltage detecting circuit 92B and the limiter circuit LM.

As shown in FIG. 13, the pre-voltage detecting circuit 92B comprises a p-channel transistor TP1, a p-channel transistor TP2, a p-channel transistor TP3, an n-channel transistor TN1, an n-channel transistor TN2, an n-channel transistor TN3, and an n-channel transistor TN4. More specifically, the p-channel transistor TP1 has the drain connected to Vdd (high-voltage side) and turns ON during power generation in accordance with the status-of-power-generation detection signal SPDET outputted from the status-of-power-generation detecting section 91. The p-channel transistor TP2 has the drain connected to the source of the p-channel transistor TP1, and has the gate to which a predetermined constant voltage VCONST is applied. The p-channel transistor TP3 has the gate to which the predetermined constant voltage VCONST is applied, and is connected to the p-channel transistor TP2 in parallel. The n-channel transistor TN1 has the source connected to the source of the p-channel transistor TP2, and has the gate and the drain which are connected in common. The n-channel transistor TN2 has the source connected to the drain of the n-channel transistor TN1, and has the gate and the drain which are connected in common. The n-channel transistor TN3 has the source connected to the drain of the n-channel transistor TN2, has the gate and the source which are connected in common, and has the drain connected to Vss (low-voltage side). The n-channel transistor TN4 has the source connected to the source of the p-channel transistor TP3, has the gate connected in common to the gate of the n-channel transistor TN3, and has the drain connected to Vss (low-voltage side).

In the above arrangement, the n-channel transistor TN3 and the n-channel transistor TN4 constitute a current mirror circuit.

The pre-voltage detecting circuit 92B starts operation in response to the status-of-power-generation detection signal SPDET indicating that power generation has been detected by the status-of-power-generation detecting section 91.

Basically, the above circuit configuration operates by employing, as a detected voltage, the potential difference which is generated due to an imbalance in the capability of transistors in set pairs.

More specifically, the p-channel transistor TP2, the n-channel transistor TN1, the n-channel transistor TN2, and the n-channel transistor TN3 constitute a first transistor group, while the p-channel transistor TP3 and the n-channel transistor TN4 constitute a second transistor group. The potential difference generated due to imbalance in capability between the first transistor group and the second transistor group is detected, and it is determined whether or not the limiter-operation-permitting signal SLMEN is outputted to the limiter-ON-voltage detecting circuit 92A.

In the pre-voltage detecting circuit 92B shown in FIG. 13, a detected voltage is set to a value which is about three times the threshold of the n-channel transistor.

In this circuit configuration, the current consumed by the entire circuit is determined by the transistor operating current, and therefore the voltage detecting operation can be achieved while consuming a very small current (approximately 10 nA).

However, because the threshold of the transistor varies due to various factors, this circuit configuration is difficult to perform the voltage detection with high precision.

In contrast, the limiter-ON-voltage detecting circuit 92A employs a circuit configuration that consumes a relatively large current, but enables the voltage detection to be performed with high precision.

More specifically, as shown in FIG. 13, the limiter-ON-voltage detecting circuit 92A comprises a NAND circuit NA, p-channel transistors TP11, TP12, and a voltage comparator CMP. The NAND circuit NA has one input terminal to which a sampling signal SSP corresponding to the limiter-ON-voltage detecting timing is applied, and the other input terminal to which the limiter-operation-permitting signal SLMEN is applied. When the limiter-operation-permitting signal SLMEN has the "H" level and the sampling signal SSP also has the "H" level, the NAND circuit NA outputs an operation control signal having the "L" level. The p-channel transistors TP11, TP12 are turned ON when the operation control signal having the "L" level is outputted. The voltage comparator CMP is supplied with power for operation when the p-channel transistor TP12 is turned ON, and compares a reference voltage VREF successively with voltages obtained by exclusively turning ON the switches SWa, SWb, SWc and dividing a voltage to be detected, i.e., the generated voltage or accumulated voltage, through selected different resistance values.

The NAND circuit NA outputs the operation control signal having the "L" level to the p-channel transistors TP11 and TP12 when the limiter-operation-permitting signal SLMEN has the "H" level and the sampling signal SSP also has the "H" level.

In response to the operation control signal having the "L" level, the p-channel transistors TP11 and TP12 are both turned ON.

As a result, the voltage comparator CMP is supplied with power for operation, and compares the reference voltage VREF successively with voltages obtained by exclusively turning ON switches SWa, SWb, SWc and dividing a voltage to be detected, i.e., the generated voltage or accumulated voltage, through selected different resistance values, followed by outputting the detected result to the limiter circuit LM or the voltage step-up/down circuit 49.

FIGS. 14A and 14B show examples of the limiter circuit LM.

FIG. 14A shows an example in which output terminals of the power generator 40 are short-circuited upon turning-ON of a switching transistor SWLM to prevent the generated voltage from being outputted to the outside.

Also, FIG. 14B shows another example in which the power generator 40 is brought into an open state upon turning-ON of a switching transistor SWLM' to prevent the generated voltage from being outputted to the outside.

Further, since the power supply section B in this embodiment includes the voltage step-up/down circuit 49, the hand operating mechanisms CS and CHM can be driven by stepping up the source voltage with the voltage step-up/down circuit 49 even when the charge voltage VC is relatively low.

Conversely, even when the charge voltage VC is relatively high as compared with the driving voltages of the hand operating mechanisms CS and CHM, the hand operating mechanisms CS and CHM can be driven by stepping down the source voltage with the voltage step-up/down circuit 49.

To that end, the central control circuit 93 decides the step-up/down factor depending on the charge voltage VC and controls the voltage step-up/down circuit 49.

However, if the charge voltage VC is too low, voltages high enough to drive the hand operating mechanisms CS and CHM cannot be produced even after stepping up the source voltage. If the operation mode is switched from the power-saving mode to the indicating mode in such a case, the timepiece fails to indicate the correct time of day and consumes power wastefully.

In this embodiment, therefore, one condition for permitting a shift from the power-saving mode to the indicating mode is ascertained by comparing the charge voltage VC with a preset voltage value Vc and determining whether or not the charge voltage VC is at a sufficient level.

Further, with reference to FIG. 6 and FIG. 7, the central control circuit 93 comprises a power-saving mode counter 101, a second-hand position counter 102, an oscillation-stop detecting circuit 103, a clock generating circuit 104, and a limiter/step-up/down control circuit 105. The power-saving mode counter 101 monitors whether or not a predetermined command operation for instructing a forcible shift to the power-saving mode is made within a predetermined time when the user operates the external input unit 100. The second-hand position counter 102 continues counting cyclically at all times, and provides a second hand position at the count value=0 which corresponds to a predetermined power-saving mode indicating position set in advance (e.g., the position at one o'clock). The oscillation-stop detecting circuit 103 detects whether or not the oscillation in the pulse combining circuit 22 has stopped, and outputs an oscillation-stop detection signal SOSC. The clock generating circuit 104 produces and outputs a clock signal CK in accordance with an output of the pulse combining circuit 22. The limiter/step-up/down control circuit 105 performs control for turning-ON/OFF of the limiter circuit LM and the step-up/down factor of the voltage step-up/down circuit 49 in accordance with the limiter-ON signal SLMON, the source-voltage detection signal SPW, the clock signal CK, and the status-of-power-generation detection signal SPDET.

Figure 15:
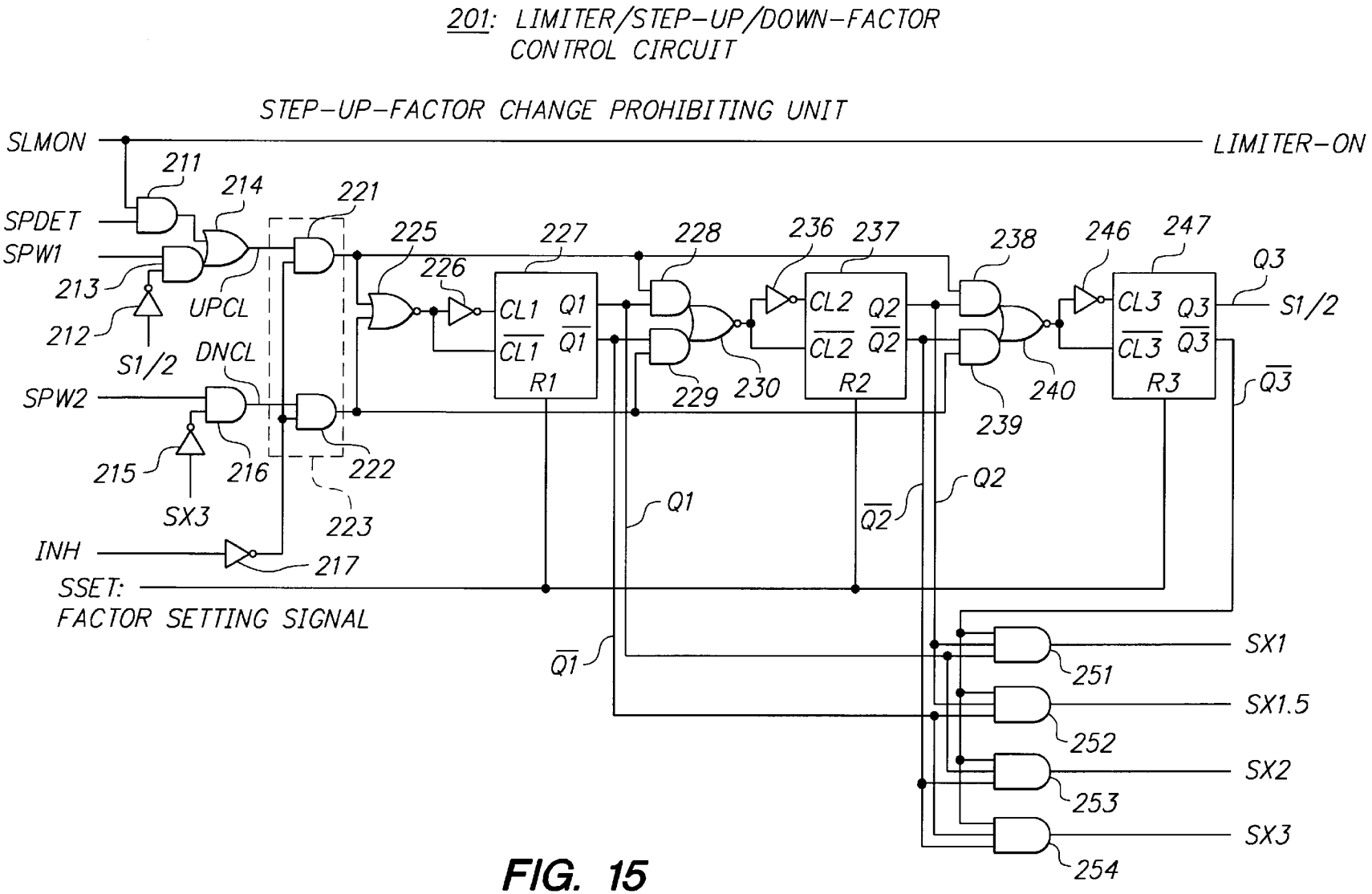
FIG. 15 shows a detailed construction of a limiter/-step-up/down-factor control circuit.
Figure 17:
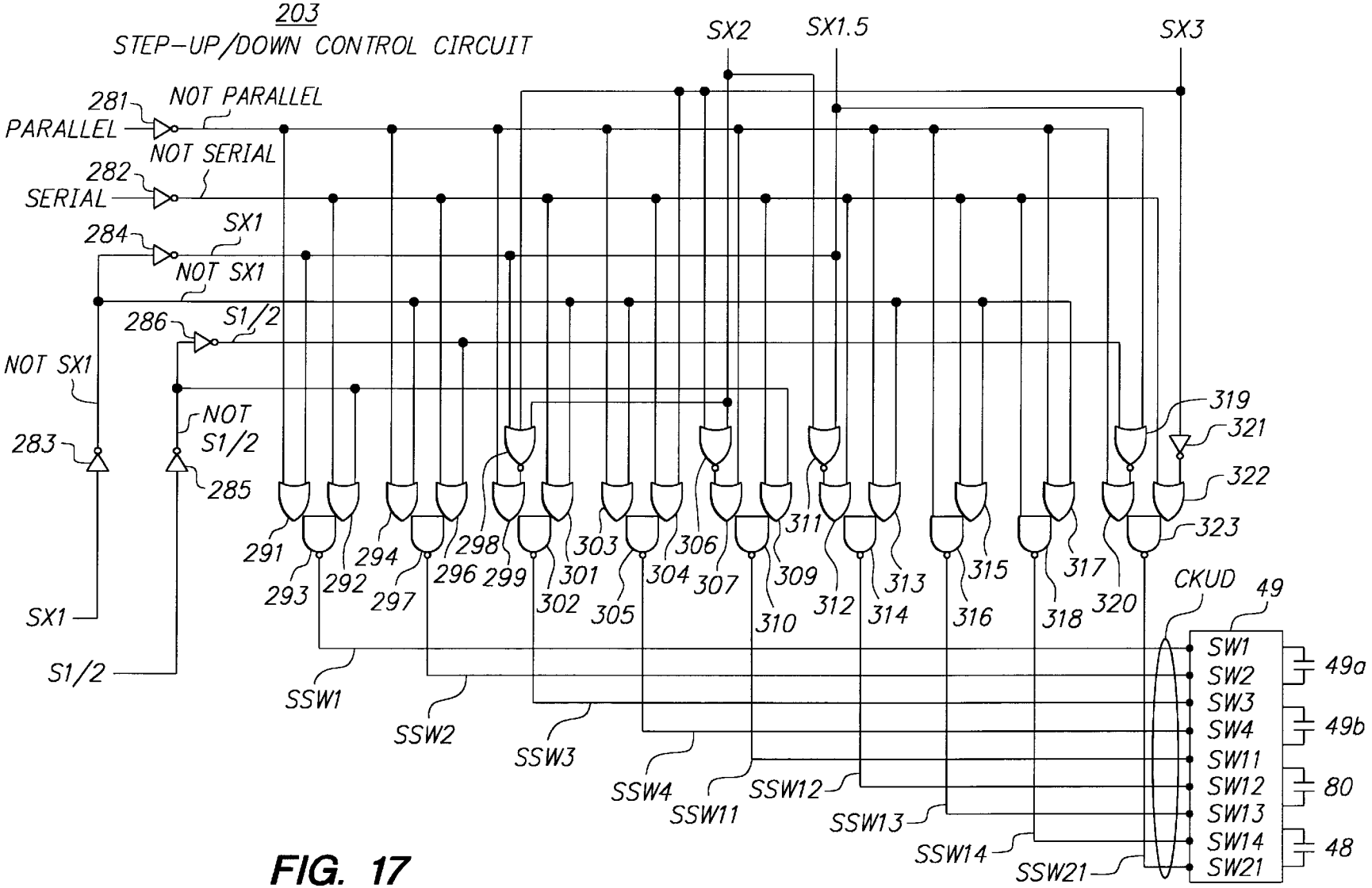
FIG. 17 shows a detailed construction of a step-up/down control circuit.

With reference to FIGS. 15 to 17, a description will now be made of a construction of the limiter/step-up/down control circuit 105 in more detail.

The limiter/step-up/down control circuit 105 mainly comprise a limiter/step-up/down-factor control circuit 201 shown in FIG. 15, a step-up/down-factor control clock generating circuit 202 shown in FIG. 16, and a step-up/down control circuit 203 shown in FIG. 17.

The limiter/step-up/down-factor control circuit 201 comprises, as shown in FIG. 15, an AND circuit 211, an inverter 212, an AND circuit 213, an OR circuit 214, an inverter 215, an AND circuit 216, and an inverter 217. The AND circuit 211 has one input terminal to which is applied the limiter-ON signal SLMON taking the "H" level when the limiter circuit LM is brought into the operative state, and the other input terminal to which is applied the status-of-power-generation detection signal SPDET outputted when the power generator 40 is in the status of power generation. The inverter 212 has an input terminal to which is applied a ½-time signal S½ taking the "H" level at ½-time step-down, and inverts the ½-time signal S½, followed by outputting an inverted ½-time signal NOT S½. The AND circuit 213 has one input terminal to which an output terminal of the inverter 212 is connected, and has the other input terminal to which a signal SPW1 is applied. The OR circuit 214 has one input terminal connected to an output terminal of the AND circuit 211, has the other input terminal connected to an output terminal of the AND circuit 213, and outputs an up-clock signal UPCL for counting up the count value used to set the step-up/down factor. The inverter 215 has an input terminal to which is applied a 3-times signal SX3 taking the "H" level at 3-times step-up, and inverts the 3-times signal SX3, followed by outputting an inverted 3-times signal NOT SX3. The AND circuit 216 has one input terminal connected to an output terminal of the inverter 215, has the other input terminal to which a signal SPW2 is applied, and outputs a down-clock signal DNCL for counting down the count value used to set the step-up/down factor. The inverter 217 has an input terminal to which is applied a step-up/down-factor change prohibiting signal INH taking the "H" level when a change of the step-up/down factor is prohibited, and inverts the step-up/down-factor change prohibiting signal INH, followed by outputting an inverted step-up/down-factor change prohibiting signal NOT INH.

Further, the limiter/step-up/down-factor control circuit 201 comprises an AND circuit 221, and an AND circuit 222. The AND circuit 221 has one input terminal to which the up-clock signal UPCL is applied, and has the other input terminal to which the inverted step-up/down-factor change prohibiting signal NOT INH is applied, thereby making ineffective an input of the up-clock signal UPCL when the inverted step-up/down-factor change prohibiting signal NOT INH takes the "L" level, i.e., when a change of the step-up/down factor is prohibited. The AND circuit 222 has one input terminal to which the down-clock signal DNCL is applied, and has the other input terminal to which the inverted step-up/down-factor change prohibiting signal NOT INH is applied, thereby making ineffective an input of the down-clock signal DNCL when the inverted step-up/down-factor change prohibiting signal NOT INH takes the "L" level, i.e., when a change of the step-up/down factor is prohibited. Incidentally, the AND circuit 221 and the AND circuit 222 cooperatively function as a step-up/down-factor change prohibiting unit 223. Moreover, the limiter/step-up/down-factor control circuit 201 comprises a NOR circuit 225, an inverter 226, a first counter 227, an AND circuit 228, an AND circuit 229 and a NOR circuit 230. The NOR circuit 225 has one input terminal connected to an output terminal of the AND circuit 221, and has the other input terminal connected to an output terminal of the AND circuit 222. The inverter 226 inverts an output signal of the NOR circuit 225 and outputs an inverted signal. The first counter 227 has a clock terminal CL1 to which an output signal of the inverter 225 is applied, has an inverted clock terminal NOT CL1 to which the output signal of the NOR circuit 225 is applied, has a reset terminal R1 to which a factor setting signal SSET is applied, and outputs a first count data Q1 and an inverted first count data NOT Q1. The AND circuit 228 has one input terminal to which the output terminal of the AND circuit 221 is connected, and has the other input terminal to which the first count data Q1 is applied. The AND circuit 229 has one input terminal to which the output terminal of the AND circuit 222 is connected, and has the other input terminal to which the inverted first count data NOT Q1 is applied. The NOR circuit 230 has one input terminal connected to an output terminal of the AND circuit 228, and has the other input terminal connected to an output terminal of the AND circuit 229.

Still further, the limiter/step-up/down-factor control circuit 201 comprises an inverter 236, a second counter 237, an AND circuit 238, an AND circuit 239 and a NOR circuit 240. The inverter 236 inverts an output signal of the NOR circuit 230 and outputs an inverted signal. The second counter 237 has a clock terminal CL2 to which an output signal of the inverter 236 is applied, has an inverted clock terminal NOT CL2 to which the output signal of the NOR circuit 230 is applied, has a reset terminal R2 to which the factor setting signal SSET is applied, and outputs a second count data Q2 and an inverted second count data NOT Q2. The AND circuit 238 has one input terminal to which the output terminal of the AND circuit 221 is connected, and has the other input terminal to which the second count data Q2 is applied. The AND circuit 239 has one input terminal to which the output terminal of the AND circuit 222 is connected, and has the other input terminal to which the inverted second count data NOT Q2 is applied. The NOR circuit 240 has one input terminal connected to an output terminal of the AND circuit 238, and has the other input terminal connected to an output terminal of the AND circuit 239.

In addition, the limiter/step-up/down-factor control circuit 201 comprises an inverter 246, a third counter 247, an AND circuit 251, an AND circuit 252, an AND circuit 253, and an AND circuit 254. The inverter 246 inverts an output signal of the NOR circuit 240 and outputs an inverted signal. The third counter 247 has a clock terminal CL3 to which an output signal of the inverter 246 is applied, has an inverted clock terminal NOT CL3 to which the output signal of the NOR circuit 240 is applied, has a reset terminal R1 to which the factor setting signal SSET is applied, and outputs a third count data Q3 (functioning as the ½-time signal S½) and an inverted third count data NOT Q3. The AND circuit 251 has a first input terminal to which the inverted third count data NOT Q3 is applied, has a second input terminal to which the second count data Q2 is applied, has a third input terminal to which the first count data Q1 is applied, and takes the logical product of those input data to output it as a 1-time signal X1 having the "H" level when the step-up/down factor provides 1-time step-up (=no step-up). The AND circuit 252 has a first input terminal to which the inverted third count data NOT Q3 is applied, has a second input terminal to which the second count data Q2 is applied, has a third input terminal to which the inverted first count data NOT Q1 is applied, and takes the logical product of those input data to output it as a 1.5-times signal X1.5 having the "H" level when the step-up/down factor provides 1.5-times step-up. The AND circuit 253 has a first input terminal to which the inverted third count data NOT Q3 is applied, has a second input terminal to which the first count data Q2 is applied, has a third input terminal to which the inverted second count data NOT Q2 is applied, and takes the logical product of those input data to output it as a 2-times signal X2 having the "H" level when the step-up/down factor provides 2-times step-up. The AND circuit 254 has a first input terminal to which the inverted third count data NOT Q3 is applied, has a second input terminal to which the inverted first count data NOT Q1 is applied, has a third input terminal to which the inverted second count data NOT Q2 is applied, and takes the logical product of those input data to output it as a 3-times signal X3 having the "H" level when the step-up/down factor provides 3-times step-up.

In this connection, the relationship among the first count data Q1, the second count data Q2, and the third count data Q3 is as shown in FIG. 18. For example, if those three data are given by;

Q1=0(="L"), Q2=0(="L"), Q3=0(="L")

the step-up/down factor is 3 times and the 3-times signal SX3 takes the "H" level. Also, if those three data are given by;

Q1=0(="L"),Q2=1(="H"), Q3=0(="L")

the step-up/down factor is 1.5 times and the 1.5-times signal SX1.5 takes the "H" level.

Further, in the case of;

Q3=1(="H")

the step-up/down factor is ½ time and the ½-time signal S½ takes the "H" level.

The step-up/down-factor control clock generating circuit 202 comprises, as shown in FIG. 16, an inverter 271 for inverting the clock signal CK; a signal delaying unit 272 for delaying an output signal of the inverter 271; an inverter 273 for inverting an output signal of the signal delaying unit 272 and outputting an inverted signal; an AND circuit 274 having one input terminal to which the clock signal CK is applied, having the other input terminal to which an output signal of the inverter 273 is applied, and taking the logical product of both the input signals to output it as a parallel signal PARALLEL; and a NOR circuit 275 having one input terminal to which the clock signal CK is applied, having the other input terminal to which the output signal of the inverter 273 is applied, and taking NOT of the logical sum of both the input signals to output it as a serial signal SERIAL.

In this case, the parallel signal PARALLEL and the serial signal SERIAL have waveforms shown, by way of example, in FIG. 19.

The step-up/down control circuit 203 comprises, as shown in FIG. 17, an inverter 281 for inverting the parallel signal PARALLEL and outputting an inverted parallel signal NOT PARALLEL; an inverter 282 for inverting the serial signal SERIAL and outputting an inverted serial signal NOT SERIAL; an inverter 283 for inverting the 1-time signal SX1 and outputting an inverted 1-time signal NOT SX1; an inverter 284 for inverting the inverted 1-time signal NOT SX1 again and outputting the 1-time signal SX1; an inverter 285 for inverting the ½-time signal S½ and outputting an inverted ½-time signal NOT S½; and an inverter 286 for inverting the inverted ½-time signal NOT S½ again and outputting the ½-time signal S½.

Further, the step-up/down control circuit 203 comprises a first OR circuit 291, a second OR circuit 292, a NAND circuit 293, a third OR circuit 294, a fourth OR circuit 296, and a NAND circuit 297. The first OR circuit 291 has one input terminal to which the parallel signal PARALLEL is applied, and has the other input terminal to which the 1-time signal SX1 is applied. The second OR circuit 292 has one input terminal to which the inverted serial signal NOT SERIAL is applied, and has the other input terminal to which the inverted ½-time signal NOT S½ is applied. The NAND circuit 293 has one input terminal connected to an output terminal of the first OR circuit 291, has the other input terminal connected to an output terminal of the second OR circuit 292, and takes the logical product of outputs of both the OR circuits to output a switch control signal SSW1 which takes the "H" level when the switch SW1 is to be turned ON, thereby controlling the switch SW1. The third OR circuit 294 has one input terminal to which the inverted parallel signal NOT PARALLEL is applied, and has the other input terminal to which the inverted 1-time signal NOT SX1 is applied. The fourth OR circuit 296 has one input terminal to which the inverted serial signal NOT SERIAL is applied, and has the other input terminal to which the 1-time signal SX1 is applied. The NAND circuit 297 has one input terminal connected to an output terminal of the third OR circuit 294, has the other input terminal connected to an output terminal of the fourth OR circuit 296, and takes the logical product of outputs of both the OR circuits to output a switch control signal SSW2 which takes the "H" level when the switch SW2 is to be turned ON, thereby controlling the switch SW2.

Moreover, the step-up/down control circuit 203 comprises a NOR circuit 298, a fifth OR circuit 299, a sixth OR circuit 301, a NAND circuit 302, a seventh OR circuit 303, an eighth OR circuit 304, and a NAND circuit 305. The NOR circuit 298 has a first input terminal to which the 1-time signal SX1 is applied, has a second input terminal to which the 3-times signal SX3 is applied, has a third input terminal to which the 2-times signal SX2 is applied, and takes NOT of the logical sum of those three input signals to output it. The fifth OR circuit 299 has one input terminal to which the inverted parallel signal NOT PARALLEL is applied, and has the other input terminal to which an output signal of the NOR circuit 298 is applied. The sixth OR circuit 301 has one input terminal to which the inverted serial signal NOT SERIAL is applied, and has the other input terminal to which the inverted 1-time signal NOT SX1 is applied. The NAND circuit 302 has one input terminal connected to an output terminal of the fifth OR circuit 299, has the other input terminal connected to an output terminal of the sixth OR circuit 301, and takes the logical product of outputs of both the OR circuits to output a switch control signal SSW3 which takes the "H" level when the switch SW3 is to be turned ON, thereby controlling the switch SW3. The seventh OR circuit 303 has one input terminal to which the inverted parallel signal NOT PARALLEL is applied, and has the other input terminal to which the inverted 1-time signal NOT SX1 is applied. The eighth OR circuit 304 has one input terminal to which the inverted serial signal NOT SERIAL is applied, and has the other input terminal to which the 3-times signal SX3 is applied. The NAND circuit 305 has one input terminal connected to an output terminal of the seventh OR circuit 303, has the other input terminal connected to an output terminal of the eighth OR circuit 304, and takes the logical product of outputs of both the OR circuits to output a switch control signal SW4 which takes the "H" level when the switch SW4 is to be turned ON, thereby controlling the switch SW4.

Still further, the step-up/down control circuit 203 comprises a NOR circuit 306, a ninth OR circuit 307, a tenth OR circuit 309, a NAND circuit 310, a NOR circuit 311, an eleventh OR circuit 312, a twelfth OR circuit 313, and a NAND circuit 314. The NOR circuit 306 has one input terminal to which the 3-times signal SX3 is applied, has the other input terminal to which the 2-times signal SX2 is applied, and takes NOT of the logical sum of both the input signals to output it. The ninth OR circuit 307 has one input terminal to which an output signal of the NOR circuit 306 is applied, and has the other input terminal to which the inverted parallel signal NOT PARALLEL is applied. The tenth OR circuit 309 has one input terminal to which the inverted serial signal NOT SERIAL is applied, has the other input terminal to which the inverted ½-time signal NOT S½ is applied, and takes the logical sum of both the input signals to output it. The NAND circuit 310 has one input terminal connected to an output terminal of the ninth OR circuit 307, has the other input terminal connected to an output terminal of the tenth OR circuit 309, and takes the logical product of outputs of both the OR circuits to output a switch control signal SSW11 which takes the "H" level when the switch SW11 is to be turned ON, thereby controlling the switch SW11. The NOR circuit 311 has a first input terminal to which the 2-times signal SX2 is applied, has a second input terminal to which the 1.5-times signal SX1.5 is applied, has a third input terminal to which the 1-time signal SX1 is applied, and takes NOT of the logical sum of those three input signals to output it. The eleventh OR circuit 312 has one input terminal to which an output signal of the NOR circuit 311 is applied, and has the other input terminal to which the inverted serial signal NOT SERIAL is applied. The twelfth OR circuit 313 has one input terminal to which the inverted parallel signal NOT PARALLEL is applied, and has the other input terminal to which the inverted 1-time signal NOT SX1 is applied. The NAND circuit 314 has one input terminal connected to an output terminal of the eleventh OR circuit 312, has the other input terminal connected to an output terminal of the twelfth OR circuit 313, and takes the logical product of outputs of both the OR circuits to output a switch control signal SSW12 which takes the "H" level when the switch SW12 is to be turned ON, thereby controlling the switch SW12.

Still further, the step-up/down control circuit 203 comprises a thirteenth OR circuit 315, a NAND circuit 316, a fourteenth OR circuit 317, and a NAND circuit 318. The thirteenth OR circuit 313 has one input terminal to which the inverted serial signal NOT SERIAL is applied, and has the other input terminal to which the inverted 1-time signal NOT SX1 is applied. The NAND circuit 316 has one input terminal to which the inverted parallel signal NOT PARALLEL is applied, has the other input terminal to which an output signal of the thirteenth OR circuit 315 is applied, and takes the logical product of the inverted parallel signal NOT PARALLEL and the output signal of the thirteenth OR circuit 315 to output a switch control signal SSW13 which takes the "H" level when the switch SW13 is to be turned ON, thereby controlling the switch SW13. The fourteenth OR circuit 317 has one input terminal to which the inverted parallel signal NOT PARALLEL is applied, and has the other input terminal to which the inverted 1-time signal NOT SX1 is applied. The NAND circuit 318 has one input terminal to which the inverted serial signal NOT SERIAL is applied, has the other input terminal to which an output signal of the fourteenth OR circuit 317 is applied, and takes the logical product of the inverted serial signal NOT SERIAL and the output signal of the fourteenth OR circuit 317 to output a switch control signal SSW14 which takes the "H" level when the switch SW14 is to be turned ON, thereby controlling the switch SW14.

In addition, the step-up/down control circuit 203 comprises a NOR circuit 319, a fifteenth OR circuit 320, an inverter 321, a sixteenth OR circuit 322, and a NAND circuit 323. The NOR circuit 319 has one input terminal to which the ½-time signal S½ is applied, and has the other input terminal to which the 1.5-times signal SX1.5 is applied. The fifteenth OR circuit 320 has one input terminal to which the inverted parallel signal NOT PARALLEL is applied, and has the other input terminal to which an output signal of the NOR circuit 319 is applied. The inverter 246 has one input terminal to which the 3-times signal SX3 is applied, and inverts the 3-times signal SX3 to output the inverted 3-times signal SX3 signal. The sixteenth OR circuit 322 has one input terminal to which the inverted serial signal NOT SERIAL is applied, has the other input terminal to which the inverted 3-times signal NOT SX3 is applied, and takes the logical sum of the inverted serial signal NOT SERIAL and the inverted 3-times signal NOT SX3 to output it. The NAND circuit 323 has one input terminal connected to an output terminal of the fifteenth OR circuit 320, has the other input terminal connected to an output terminal of the sixteenth OR circuit 322, and takes the logical product of outputs of both the OR circuits to output a switch control signal SSW21 which takes the "H" level when the switch SW21 is to be turned ON, thereby controlling the switch SW21.

As a result of the above construction, the step-up/down control circuit 203 outputs the switch control signals SSW1, SSW2, SSW3, SSW4, SSW11, SSW12, SSW13, SSW14 and SSW21 corresponding to the operation of the voltage step-up/down circuit, described above in connection with FIG. 3, at the timings based on the parallel signal NOT PARALLEL and the serial signal NOT SERIAL.

The mode thus set is stored in the mode storage or memory 94, and the stored information is supplied to the drive control circuit 24, the time information storage 96, and the set-value changing section 95. Upon a shift from the indicating mode to the power-saving mode, the drive control circuit 24 stops supply of pulse signals to the second-hand driving section 30S and the hour/minute-hand driving section 30HM, thereby stopping the operations of the second-hand driving section 30S and the hour/minute-hand driving section 30HM. As a result, the motor 10 ceases to rotate and the time indication is stopped.

The time information storage 96 is constructed of, more concretely, an up/down counter (not shown). Upon a shift from the indicating mode to the power-saving mode, the up/down counter receives a reference signal generated by the pulse combining circuit 22 and starts measurement of time by counting up a count value (up-count). Thus, a period of time during which the power-saving mode continues is measured with the count value.

Also, upon a shift from the power-saving mode to the indicating mode, the up/down counter counts down the count value (down-count), and during the down-count, the drive control circuit 24 outputs fast-forward pulses supplied to the second-hand driving section 30S and the hour/minute-hand driving section 30HM.

When the count value of the up/down counter becomes zero, i.e., when a duration of the power-saving mode and a fast-forward hand operating time corresponding to a duration of the fast-forwarding of the hands lapse, a control signal for stopping delivery of the fast-forward pulses is generated and supplied to the second-hand driving section 30S and the hour/minute-hand driving section 30HM.

As a result, the time indication is restored to the current time of day.

Thus, the time information storage 96 has also a function of restoring the time indication to the current time of day when it is to be indicated again.

The drive control circuit 24 produces driving pulses corresponding to the modes based on various pulses outputted from the pulse combining circuit 22. First, in the power-saving mode, the drive control circuit 24 stops supply of the driving pulses. Then, immediately after a shift from the power-saving mode to the indicating mode, fast-forward pulses having short pulse intervals are supplied as the driving pulses to the second-hand driving section 30S and the hour/minute-hand driving section 30HM for restoring the time indication to the current time of day when it is to be indicated again.

Next, after the end of supply of the fast-forward pulses, the driving pulses having normal pulse intervals are supplied to the second-hand driving section 30S and the hour/minute-hand driving section 30HM.

[3] Operation of Embodiment

[3.1]

Prior to explaining the operation of the timepiece of this embodiment, a description will be made of the relationship between the status of power generation and the operation of the voltage step-up/down circuit 49 with reference to FIG. 8.

There occurs a difference in magnitude of the charging current outputted from the power generating section A between the charging under a strong influence and the charging under a moderate influence.

More specifically, in the case of employing a solar cell as the power generator, the charging current is 2.5 mA when a solar cell, incorporated in the timepiece and having a size comparable to that of a wristwatch, is subjected to irradiation of extraneous light of 50,000 LX (lux) that corresponds to luminous intensity in the open air under the blue sky; and the charging current is 0.05 mA when it is subjected to irradiation of extraneous light of 1000 LX that corresponds to ordinary luminous intensity typically falling on a user's desk. The charging voltage (which initial voltage+internal resistance during charging×charging current) in each of the above conditions is respectively 1.50 V and 1.01 V.

In the case of employing, as the power generator, an electromagnetic induction type power generator which has a size suitable for a wristwatch and using a rotating weight, the charging current is 5 mA when a power generation rotor is fast rotated (i.e., when a timepiece incorporating an electromagnetic induction type power generator is strongly swung), and is 0.1 mA when the power generation rotor is slowly rotated (i.e., when the timepiece incorporating the electromagnetic induction type power generator is weakly swung). The charging voltage (which=) initial voltage+internal resistance during charging×charging current) in each of the above conditions is respectively 2.00 V and 1.02 V, as shown in FIG. 8.

When operating a timepiece, there is a voltage value suitable for operation or an absolute rated voltage value which must not be exceeded. Assuming that the voltage value suitable for operation or the absolute rated voltage value is 3.1 V, this means that the voltage after step-up must not exceed 3.1 V.

More specifically, in the above case of employing the solar cell, the step-up factor must be not larger than 2 times when the timepiece is subjected to extraneous light of 50,000 LX (lux), and the step-up factor up to 3 times is allowed when the timepiece is subjected to extraneous light of 1000 LX.

Likewise, in the above case of employing the electromagnetic induction type power generator, the step-up factor must be not larger than 1.5 times when the power generation rotor is fast rotated, and the step-up factor up to 3 times is allowed when the power generation rotor is slowly rotated.

[3.2] Operation of Embodiment

Figure 9:
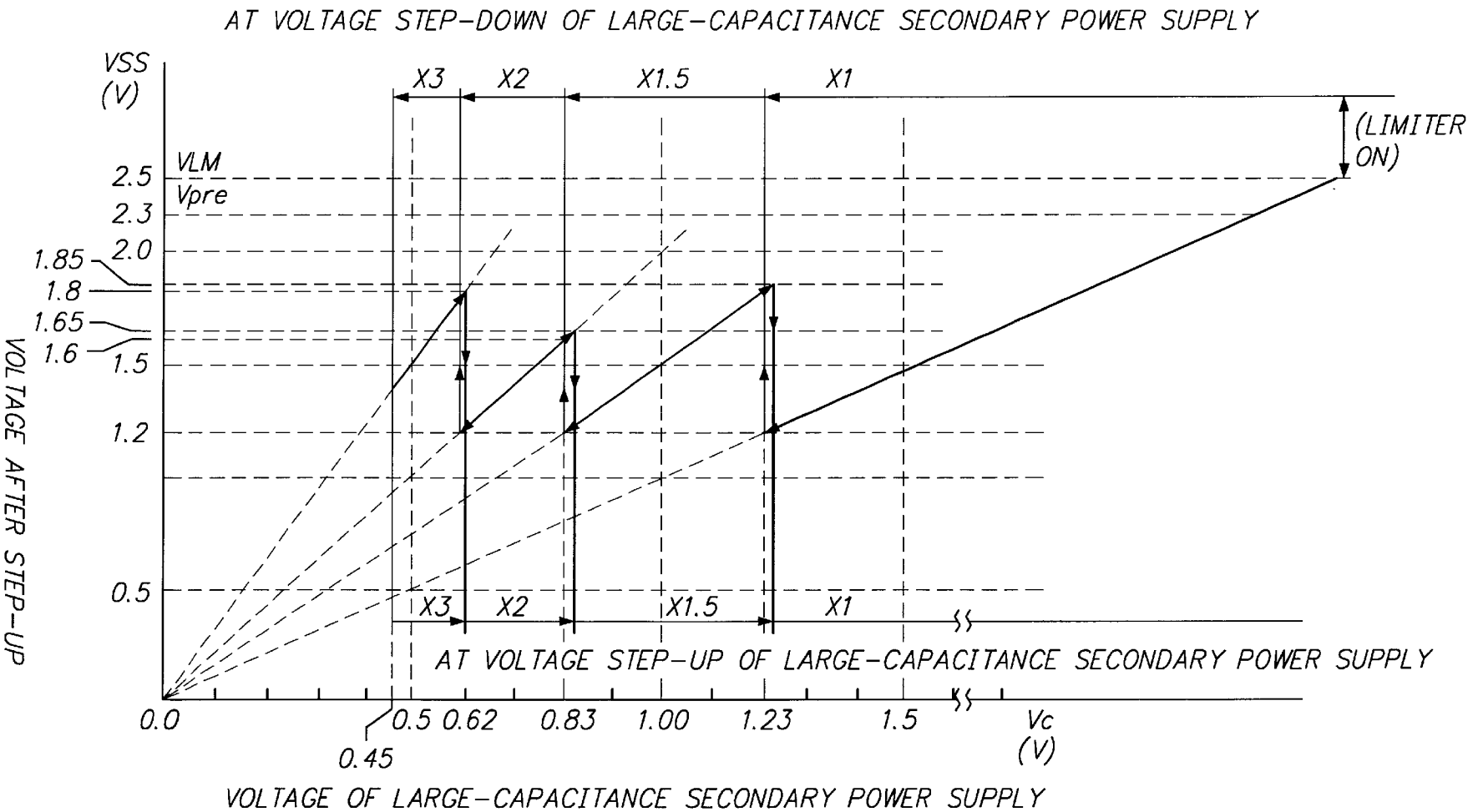
FIG. 9 is a first diagram for explaining the operation of the embodiment of the present invention.

Hereinbelow, the operation of the embodiment is described with reference to FIGS. 9 and 10.

It is assumed that, initially, the status-of-power-generation detecting section 91 is in the operative state, the limiter circuit LM is in the inoperative state, the voltage step-up/down circuit 49 is in the inoperative state, the limiter-ON-voltage detecting circuit 92A is in the inoperative state, the pre-voltage detecting circuit 92B is in the inoperative state, and the source-voltage detecting circuit 92C is in the operative state.

It is also assumed that, initially, the voltage of the large-capacitance secondary power supply 48 is lower than 0.45 V.

Further, it is assumed that the minimum voltage necessary for driving the hand operating mechanisms CS and CHM is set to be lower than 1.2 V.

[3.2.1] Voltage Step-up of Large-capacitance Secondary Power Supply

[3.2.1.1] At Voltages of 0.0–0.62 V

When the voltage of the large-capacitance secondary power supply is lower than 0.45 V, the voltage step-up/down circuit 49 is in the inoperative state, and the source voltage detected by the source-voltage detecting circuit 92C is also lower than 0.45 V. Therefore, the hand operating mechanisms CS and CHM remain in the driven state.

Figure 10:
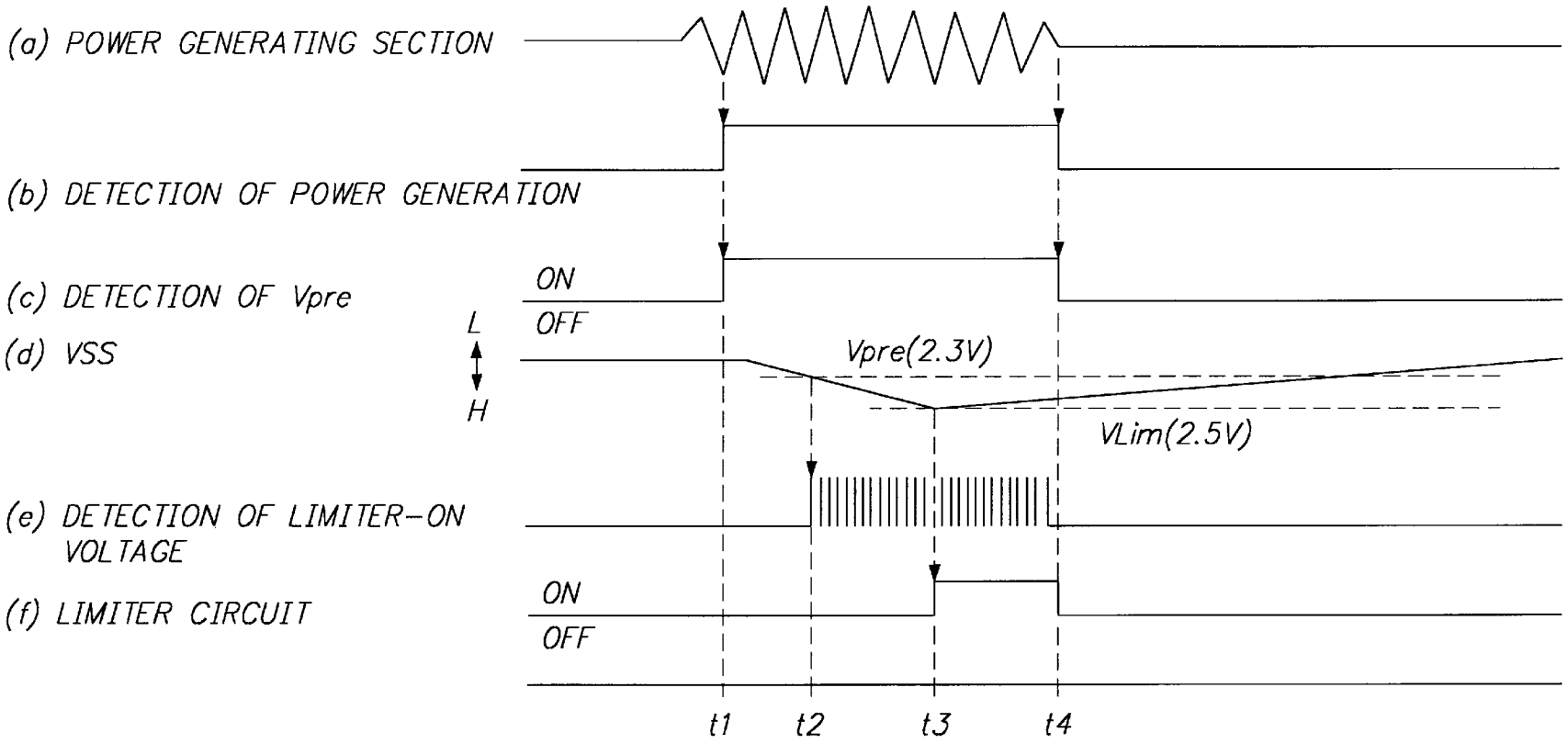
FIG. 10 is a second diagram for explaining the operation of the embodiment of the present invention.

Thereafter, when power generation by the power generator 40 is detected by the status-of-power-generation detecting section 91 at the time t1 shown in FIG. 10, the pre-voltage detecting circuit 92B is brought into the operative state as shown in FIG. 10, part (c).

Then, when the voltage of the large-capacitance secondary power supply exceeds 0.45 V, the limiter/-step-up/down control circuit 105 makes control to perform the 3-times step-up operation by the voltage step-up/down circuit 49 in accordance with the source-voltage detection signal SPW from the source-voltage detecting circuit 92C.

Accordingly, the voltage step-up/down circuit 49 performs the 3-times step-up operation, and this condition is continued by the limiter/step-up/down control circuit 105 until the voltage of the large-capacitance secondary power supply reaches 0.62 V.

As a result, the charge voltage of the auxiliary capacitor 80 becomes not lower than 1.35 V, whereby the hand operating mechanisms CS and CHM are brought into the driven state.

In this connection, there is a possibility that, depending on the situation of power generation, e.g., when the timepiece is quite strongly swung, the generated voltage may abruptly rise to such an extent as exceeding, e.g., the absolute rated voltage. The limiter/step-up/down control circuit 105 is therefore designed such that the step-up/down factor is controlled depending on the situation of power generation to perform the 2- or 1.5-times step-up operation rather than the 3-times step-up operation in such an event. Consequently, the operating voltage can be supplied in a stabler manner. This is equally applied to the following case. [3.2.1.2] At Voltages 0.62 V–0.83 V When the voltage of the large-capacitance secondary power supply exceeds 0.62 V, the limiter/step-up/down control circuit 105 controls performance of the 2-times step-up operation by the voltage step-up/down circuit 49 in accordance with the source-voltage detection signal SPW from the source-voltage detecting circuit 92C.

Accordingly, the voltage step-up/down circuit 49 performs the 2-times step-up operation, and this condition is continued by the limiter/step-up/down control circuit 105 until the voltage of the large-capacitance secondary power supply reaches 0.83 V.

As a result, the charge voltage of the auxiliary capacitor 80 becomes not lower than 1.24 V, whereby the hand operating mechanisms CS and CHM remain in the driven state continuously.

[3.2.1.3] At Voltages of 0.83 V–1.23 V.

When the voltage of the large-capacitance secondary power supply exceeds 0.83 V, the limiter/step-up/down control circuit 105 controls performance of the 1.5-times step-up operation by the voltage step-up/down circuit 49 in accordance with the source-voltage detection signal SPW from the source-voltage detecting circuit 92C.

Accordingly, the voltage step-up/down circuit 49 performs the 2-times step-up operation, and this condition is continued by the limiter/step-up/down control circuit 105 until the voltage of the large-capacitance secondary power supply reaches 1.23 V.

As a result, the charge voltage of the auxiliary capacitor 80 becomes not lower than 1.24 V, whereby the hand operating mechanisms CS and CHM remain in the driven state continuously.

[3.2.1.4] At Voltages not Lower Than 1.23 V

When the voltage of the large-capacitance secondary power supply exceeds 1.23 V, the limiter/step-up/down control circuit 105 controls performance of the 1time step-up operation, i.e., the non-step-up operation, by the voltage step-up/down circuit 49 in accordance with the source-voltage detection signal SPW from the source-voltage detecting circuit 92C.

Accordingly, the voltage step-up/down circuit 49 performs the 1-time step-up operation, and this condition is continued by the limiter/step-up/down control circuit 105 until the voltage of the large-capacitance secondary power supply lowers down below 1.23 V.

As a result, the charge voltage of the auxiliary capacitor 80 becomes not lower than 1.23 V, whereby the hand operating mechanisms CS and CHM remain in the driven state continuously.

Then, at the time t2 shown in FIG. 10, when the pre-voltage detecting circuit 92B detects that the voltage of the large-capacitance secondary power supply 48 exceeds the pre-voltage VPRE (2.3 V in FIGS. 9 and 10), the pre-voltage detecting circuit 92B outputs the limiter-operation-permitting signal SLMEN to the limiter-ON-voltage detecting circuit 92A, bringing it into the operative state. The limiter-ON-voltage detecting circuit 92A compares the charge voltage VC of the large-capacitance secondary power supply 48 with the preset limiter-ON reference voltage VLMON at predetermined sampling intervals, as shown in FIG. 10, in part (e), thereby detecting whether or not to bring the limiter circuit LM into the operative state.

In this connection, the power generating section A generates power intermittently. Assuming that the cycle of power generation is a value not lower than a first cycle, the limiter-ON-voltage detecting circuit 92A performs detection at sampling intervals having a second cycle not higher than the first cycle.

Then, at the time t3 shown in FIG. 10, when the charge voltage VC of the large-capacitance secondary power supply 48 exceeds 2.5 V, the limiter-ON signal SLMON is outputted to the limiter circuit LM for bringing it into the ON-state.

As a result, the limiter circuit LM electrically disconnects the power generating section A from the large-capacitance secondary power supply 48.

It is therefore possible to avoid the excessive generated voltage VGEN from being applied to the large-capacitance secondary power supply 48, and to prevent the large-capacitance secondary power supply 48 and hence the timepiece 1 from being damaged due to application of a voltage that exceeds the withstanding voltage of the large-capacitance secondary power supply 48.

Subsequently, at the time t4 shown in FIG. 10, when the status-of-power-generation detecting section 91 ceases to detect the status of power generation and stops outputting of the status-of-power-generation detection signal SPDET, the limiter circuit LM is brought into the OFF-state, and the limiter-ON-voltage detecting circuit 92A, the pre-voltage detecting circuit 92B, and the source-voltage detecting circuit 92C are brought into the inoperative state regardless of the charge voltage VC of the large-capacitance secondary power supply 48.

[3.2.1.5] Measure Required in Increasing Step-up Factor

When the voltage step-up/down circuit 49 is operating to step up the voltage of the large-capacitance secondary power supply 48 with the limiter circuit LM held in the ON-state, it may be required to reduce the step-up factor or stop the step-up operation for ensuring safety.

Generally speaking, it is required that when the generated voltage of the power generator 40 is determined to have become not lower than the preset limiter-ON voltage based on a result detected by the limiter-ON-voltage detecting circuit 92A, and also the voltage step-up/down circuit 49 is operating to step up the voltage, a step-up factor N (where N is a real number) is set to N' (where N' is a real number and satisfies $1 \leqq N' < N$).

Such a measure is intended to surely prevent the occurrence of a damage upon the voltage stepped up in excess of the absolute rated voltage, etc. when an abrupt voltage rise is anticipated, e.g., when the situation is shifted from the status of non-power-generation to the status of power generation.

[3.2.2] Voltage Step-down of Large-capacitance Secondary Power Supply

[3.2.2.1] At Voltages not Lower than 1.20 V

In a condition that the charge voltage VC of the large-capacitance secondary power supply 48 is over 2.5 V, the limiter-ON signal SLMON is outputted to the limiter circuit LM for bringing it into the ON-state. Thus, the limiter circuit LM electrically disconnects the power generating section A from the large-capacitance secondary power supply 48.

In this condition, the limiter-ON-voltage detecting circuit 92A, the prevoltage detecting circuit 92B, and the source-voltage detecting circuit 92C are all in the operative state.

Thereafter, when the charge voltage VC of the large-capacitance secondary power supply 48 drops below 2.5 V, the limiter-ON-voltage detecting circuit 92A stops outputting of the limiter-ON signal SLMON to the limiter circuit LM for bringing it into the OFF-state.

When the charge voltage VC of the large-capacitance secondary power supply 48 further lowers drops 2.3 V, the pre-voltage detecting circuit 92B ceases to output the limiter-operation-permitting signal SLMEN to the limiter-ON-voltage detecting circuit 92A, whereby the limiter-ON-voltage detecting circuit 92A is brought into the inoperative state and the limiter circuit LM is held in the OFF-state.

Additionally, in the above condition, the limiter/-step-up/down control circuit 105 continues to control performance of the 1-time step-up operation, i.e., the non-step-up operation, by the voltage step-up/down circuit 49 in accordance with the source-voltage detection signal SPW from the source-voltage detecting circuit 92C, causing the hand operating mechanisms CS and CHM to remain in the driven state continuously.

[3.2.2.2] At Voltages of 1.20 V–0.80 V

When the voltage of the large-capacitance secondary power supply drops below 1.23 V, the limiter/step-up/down control circuit 105 makes control to perform the 1.5-times step-up operation by the voltage step-up/down circuit 49 in accordance with the source-voltage detection signal SPW from the source-voltage detecting circuit 92C.

Accordingly, the voltage step-up/down circuit 49 performs the 1.5-times step-up operation, and this condition is continued by the limiter/step-up/down control circuit 105 until the voltage of the large-capacitance secondary power supply reaches 0.80 V.

As a result, the charge voltage of the auxiliary capacitor 80 stays between 1.24 V and 1.8 V, whereby the hand operating mechanisms CS and CHM remain in the driven state continuously.

[3.2.2.3] At Voltages of 0.80 V–0.60 V

When the voltage of the large-capacitance secondary power supply drops below 0.80 V, the limiter/step-up/down control circuit 105 controls performance of the 2-times step-up operation by the voltage step-up/down circuit 49 in accordance with the source-voltage detection signal SPW from the source-voltage detecting circuit 92C.

Accordingly, the voltage step-up/down circuit 49 performs the 2-times step-up operation, and this condition is continued by the limiter/step-up/down control circuit 105 until the voltage of the large-capacitance secondary power supply reaches 0.60 V.

As a result, the charge voltage of the auxiliary capacitor 80 stays between 1.20 V and 1.6 V, whereby the hand operating mechanisms CS and CHM remain in the driven state continuously.

[3.2.2.4] At Voltages of 0.6 V–0.45 V

When the voltage of the large-capacitance secondary power supply drops below 0.6 V, the limiter/step-up/down control circuit 105 controls performance of the 3-times step-up operation by the voltage step-up/down circuit 49 in accordance with the source-voltage detection signal SPW from the source-voltage detecting circuit 92C.

Accordingly, the voltage step-up/down circuit 49 performs the 3-times step-up operation, and this condition is continued by the limiter/step-up/down control circuit 105 until the voltage of the large-capacitance secondary power supply reaches 0.45 V.

As a result, the charge voltage of the auxiliary capacitor 80 stays between 1.35 V and 1.8 V, whereby both the hand operating mechanisms CS and CHM remain in the driven state continuously.

[3.2.2.5] At Voltages Lower Than 0.45 V

When the voltage of the large-capacitance secondary power supply 48 drops below 0.45 V, the voltage step-up/down circuit 49 is brought into the inoperative state, and the hand operating mechanisms CS and CHM are brought into the non-driven state, while only charging of the large-capacitance secondary power supply 48 is allowed.

It is therefore possible to reduce useless power consumption in the step-up operation, and to shorten the time taken for driving the hand operating mechanisms CS and CHM again.

[3.2.2.6] Measure Required in Decreasing Step-up Factor

It is required not to decrease the step-up factor again until a period of time enough for the charge voltage VC to stabilize actually lapses after the timing at which the step-up factor was previously decreased (e.g., from 2 times to 1.5 times).

The reason is that the step-up factor would become too low if decreased so, because even upon the step-up factor being decreased, the actual voltage after the step-up operation is not changed in a moment, but it lowers gradually toward the voltage to be achieved after the decrease of the step-up factor.

Generally speaking, it is required to take a measurement to determine whether or not a predetermined factor-change prohibiting time has lapsed from the timing at which the step-up factor N (where N is a real number) was changed to N' (where N' is a real number and satisfies $1 \leqq N' < N$), and to prohibit a change of the step-up factor until the predetermined factor-change prohibiting time lapses from the timing at which the step-up factor N was previously changed to N'.

[3.3] Advantages of Embodiment

With this embodiment, as described above, until the power generating section A enters the status of power generation and the status-of-power-generation detection signal SPDET is outputted from the status-of-power-generation detecting section 91, the limiter circuit LM is not required to be operated, and therefore all the detecting circuits, i.e., the limiter-ON-voltage detecting circuit 92A, the prevoltage detecting circuit 92B and the source-voltage detecting circuit 92C, can be held in the inoperative state, resulting in a reduction of power consumption.

Also, even when the status-of-power-generation detection signal SPDET is outputted from the status-of-power-generation detecting section 91, the limiter-operation-permitting signal SLMEN is not outputted from the prevoltage detecting circuit 92B until the voltage of the large-capacitance secondary power supply 48 exceeds the prevoltage VPRE. Accordingly, the limiter-ON-voltage detecting circuit 92A, which consumes large power for detection of voltage with high precision, still remains in the inoperative state, resulting in a reduction of power consumption.

Further, even under a situation in which the limiter circuit LM is in the ON-state, or in which the limiter-ON-voltage detecting circuit 92A is in the operative state, when the status-of-power-generation detection signal SPDET ceases to be outputted from the status-of-power-generation detecting section 91, the limiter-ON-voltage detecting circuit 92A and the pre-voltage detecting circuit 92B are brought into the inoperative state.

Stopping of outputting of the status-of-power-generation detection signal SPDET means that power is not generated and the charge voltage VC of the large-capacitance secondary power supply 48 is not increased from a value at that time, and hence that the limiter circuit LM may be brought into the inoperative state (OFF). So, the limiter circuit LM is brought into the inoperative state.

Consequently, in the condition that power is not generated, it is required to neither perform the detection of voltages, nor bring the circuits for detecting the voltages into the operative state, whereby power consumption can be surely reduced.

[3.4] Modifications of Embodiment

[3.4.1] First Modification

The limiter-ON voltage is detected at the sampling timing in the above description, but it may be detected continuously.

[3.4.2] Second Modification

As a matter of course, the various voltage values mentioned in the above description are merely examples, and they are appropriately changed depending on portable electronic devices to which the present invention is applied.

[3.4.3] Third Modification

Figure 11:
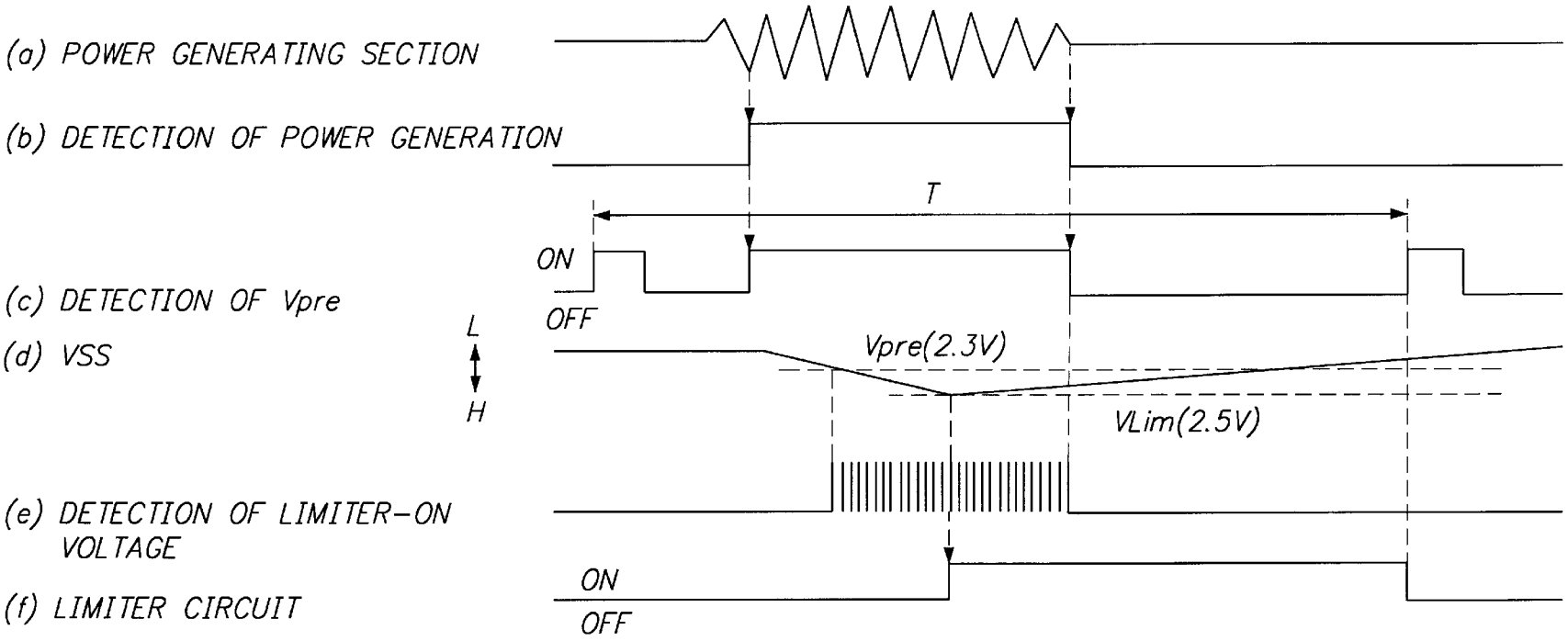
FIG. 11 is a diagram for explaining the operation of a third modification of the embodiment.

In the above description, when the status of non-power-generation is detected after the limiter circuit LM has shifted to the ON-state, the limiter circuit LM, the limiter-ON-voltage detecting circuit 92A, the pre-voltage detecting circuit 92B, the source-voltage detecting circuit 92C, etc. are brought into the inoperative state. However, as shown in FIG. 11, the circuit configuration may be modified such that when the pre-voltage detecting circuit 92B ceases to detect the pre-voltage VPRE after the limiter circuit LM has shifted to the ON-state, the limiter circuit LM, the limiter-ON-voltage detecting circuit 92A, the pre-voltage detecting circuit 92B, the source-voltage detecting circuit 92C, etc. are brought into the inoperative state.

In this case, the pre-voltage detecting circuit 92B requires to be brought into the operative state for each predetermined cycle TPRE to detect the pre-voltage VPRE.

[3.4.4] Fourth Modification

While the above embodiment has been described taking as an example a timepiece indicating respectively hours/minutes and seconds with two motors, the present invention is also applicable to a time piece indicating hours, minutes and seconds with one motor.

On the other hand, the present invention is further applicable to a time piece having three or more motors (i.e., motors for separately controlling a second hand, minute hand, hour hand, calendar, chronograph, etc.).

[3.4.5] Fifth Modification

While the above embodiment employs, as the power generator 40, an electromagnetic power generator wherein a rotary motion of the rotating weight 45 is transmitted to the rotor 43 and the electromotive force Vgen is generated in the output coil 44 with the rotation of the rotor 43, the present invention is not limited to the use of such a motor. The present invention may also use, for example, a power generator wherein a rotary motion is produced by a restoring force (corresponding to first energy) of a spring and an electromotive force is generated with the rotary motion, or a power generator wherein an external or self-excited vibration or displacement (corresponding to first energy) is applied to a piezoelectric body and power is produced with the piezoelectric effect.

Further, the power generator may produce power through optoelectric conversion utilizing optical energy (corresponding to first energy) such as sunlight.

Moreover, the power generator may produce power through thermal power generation utilizing a temperature difference between one location and another location (i.e., thermal energy corresponding to first energy).

Additionally, the power generator may be constructed as an electromagnetic induction type generator which receives stray electromagnetic waves such as broadcasting and communications electric waves, and produces power by utilizing energy of the electric waves (corresponding to first energy).

[3.4.6] Sixth Modification

While the above embodiment has been described taking as an example the timepiece 1 of the wristwatch type, an application of the present invention is not limited to that type of timepiece. In addition to the wristwatch, the timepiece may be in the form a pocket watch or the like. The present invention is further adaptable for portable electronic apparatuses such as pocket-size calculators, cellular phones, portable personal computers, electronic notepads, portable radios, and portable VTRs.

[3.4.7] Seventh Modification

While in the above embodiment the reference potential (GND) is set to Vdd (high-potential side), the reference potential (GND) may be as a matter of course set to Vss (low-potential side). In this case, the set voltage values Vo and Vbas indicate potential differences with respect to detection levels set on the high-voltage side with Vss being a reference.

[3.4.8] Eighth Modification

While the embodiment has been described above as performing control in accordance with the charge voltage VC of the large-capacitance secondary power supply 48, the control may be performed in accordance with the charge voltage VC1 of the auxiliary capacitor 80 or the output voltage of the voltage step-up/down circuit 49.

[4] Forms of Present Invention

The following forms are conceived as preferable forms in implementing the present invention.

[4.1] First Form

According to a first form of the present invention, in a control method for an portable electronic device comprising a power generating device for generating power through conversion from first energy to second energy in the form of electrical energy, a power supply device for accumulating the electrical energy produced by the power generation, and a driven device driven with the electrical energy supplied from the power supply device, the method may comprise a power-generation detecting step of detecting whether or not power is generated by the power generating device; a limiter-ON-voltage detecting step of detecting whether or not a voltage generated by the power generating device or a voltage accumulated in the power supply device exceeds a preset limiter-ON voltage; a limiting step of limiting the voltage of the electrical energy to be supplied to the power supply device to a predetermined reference voltage set in advance when it is determined based on a detection result in the limiter-ON-voltage detecting step that the voltage generated by the power generating device or the voltage accumulated in the power supply device has become not lower than the preset limiter-ON voltage; and a limiter-ON-voltage detection prohibiting step of prohibiting the detecting operation in the limiter-ON-voltage detecting step when it is determined based on a detection result in the power-generation detecting step that power is not generated by the power generating device (basic form of the first form).

In the above basic form, the portable electronic device may further comprise a generated-voltage detecting step of detecting a voltage generated by the power generating device, and the limiter-ON-voltage detection prohibiting step includes a limiter-ON-voltage detection control step of prohibiting the detecting operation in the limiter-ON-voltage detecting step when it is determined based on a detection result in the generated-voltage detecting step that the generated voltage is not higher than a predetermined limiter control voltage that is lower than the limiter-ON voltage, and allowing the detecting operation in the limiter-ON-voltage detecting step when the generated voltage exceeds the predetermined limiter control voltage.

Further, in the above basic form, the power generating step may be implemented by a power generating device for intermittently generating power with intervals not lower than a first cycle, and the limiter-ON-voltage detecting step may detect whether or not the voltage accumulated in the power supply device exceeds the preset limiter-ON voltage, with a second cycle not larger than the first cycle.

[4.2] Second Form

According to a second form of the present invention, in a control method for a portable electronic device comprising a power generating device for generating power through conversion from first energy to second energy in the form of electrical energy, a power supply device for accumulating the electrical energy produced by the power generation, a source-voltage stepping-up device for stepping up a voltage of the electrical energy supplied from the power supply device at a step-up factor N (where N is a real number larger than 1) and supplying the stepped-up voltage as driving power, and a driven device driven with the driving power supplied from the source-voltage stepping-up device, the method may comprise a power-generation detecting step of detecting whether or not power is generated by the power generating device; a limiter-ON-voltage detecting step of detecting whether or not at least one of a voltage generated by the power generating device, a voltage accumulated in the power supply device and a voltage of the driving power after being stepped up exceeds a preset limiter-ON voltage; a limiting step of limiting the voltage of the electrical energy to be supplied to the power supply device to a predetermined reference voltage set in advance when it is determined based on a detection result in the limiter-ON-voltage detecting step that at least one of the voltage generated by the power generating device, the voltage accumulated in the power supply device and the voltage of the driving power after being stepped up has become not lower than the preset limiter-ON voltage; a limiter-ON-voltage detection prohibiting step of prohibiting the detecting operation in the limiter-ON-voltage detecting step when it is determined based on a detection result in the power-generation detecting step that power is not generated by the power generating device; and a step-up factor changing step of setting the step-up factor N to N' (where N' is a real number and satisfies $1 \leqq N' < N$) when it is determined based on a detection result in the limiter-ON-voltage detecting step that at least one of the voltage generated by the power generating device, the voltage accumulated in the power supply device and the voltage of the driving power after being stepped up has become not lower than the preset limiter-ON voltage, and also when the source-voltage stepping-up device is performing step-up operation. The step-up factor changing step may include a time-lapse determining step of determining whether or not a predetermined factor-change prohibiting time set in advance has lapsed from the timing at which the step-up factor N was previously changed to N'; and a change prohibiting step of prohibiting a change of the step-up factor until the predetermined factor-change prohibiting time set in advance lapses from the timing at which the step-up factor N was previously changed to N'.

[4.3] Third Form

According to a third form of the present invention, in a control method for a portable electronic device comprising a power generating device for generating power through conversion from first energy to second energy in the form of electrical energy, a power supply device for accumulating the electrical energy produced by the power generation, a source-voltage stepping-up/down device for stepping up or down a voltage of the electrical energy supplied from the power supply device at a step-up factor n (where n is a positive real number) and supplying the stepped-up/down voltage as driving power, a driven device driven with the driving power supplied from the source-voltage stepping-up/down device, and a power-generation detecting device for detecting whether or not power is generated by the power generating device, the method may comprise a limiter-ON-voltage detecting step of detecting whether or not at least one of a voltage generated by the power generating device, a voltage accumulated in the power supply device and a voltage of the driving power after being stepped up or down exceeds a preset limiter-ON voltage; a limiting step of limiting the voltage of the electrical energy to be supplied to the power supply device to a predetermined reference voltage set in advance when it is determined based on a detection result in the limiter-ON-voltage detecting step that at least one of the voltage generated by the power generating device, the voltage accumulated in the power supply device and the voltage of the driving power after being stepped up or down has become not lower than the preset limiter-ON voltage; a limiter-ON-voltage detection prohibiting step of prohibiting the detecting operation in the limiter-ON-voltage detecting step when it is determined based on a detection result of the power-generation detecting device that power is not generated by the power generating device; and a step-up/down factor changing step of setting the step-up factor n to n' (where n' is a positive real number and satisfies $n' < n$) when it is determined based on a detection result in the limiter-ON-voltage detecting step that at least one of the voltage generated by the power generating device, the voltage accumulated in the power supply device and the voltage of the driving power after being stepped up or down has become not lower than the preset limiter-ON voltage (basic form of the third form).

In the above basic form, the step-up/down factor changing step may include a time-lapse determining step of determining whether or not a predetermined factor-change prohibiting time set in advance has lapsed from the timing at which the step-up/down factor N was previously changed to N'; and a change prohibiting step of prohibiting a change of the step-up/down factor until the predetermined factor-change prohibiting time set in advance lapses from the timing at which the step-up/down factor N was previously changed to N' (first modification of the third form).

Further, in the above first modification of the third form, the source-voltage stepping-up/down device may have a number M (M is an integer not less than 2) of step-up/down capacitors for step-up/down operation; and in the step-up/down operation, a number L (where L is an integer not less than 2 but not more than M) of ones among the number M of step-up/down capacitors may be connected in series to be charged with the electrical energy supplied from the power supply device, and the number L of step-up/down capacitors may be then connected in parallel to produce a voltage lower than the electrical energy supplied from the power supply device, the produced lower voltage being used as a voltage after the step-down operation or being added to another voltage to produce a voltage after the step-up operation.

[4.4] Fourth Form

According to a fourth form of the present invention, in each of the above forms, the limiter device may be brought into the inoperative state when power is not generated by the power generating means.

[4.5] Fifth Form

According to a fifth form of the present invention, in each of the above forms, the limiter device may be brought into the inoperative state when an operating mode of the portable electronic device is in a power-saving mode.

[4.6] Sixth Form

According to a sixth form of the present invention, the power-generation detecting step may detect whether or not power is generated, in accordance with a level of the generated voltage and a duration of power generation by the power generating device.

[4.7] Seventh Form

According to a seventh form of the present invention, in a control method for a portable electronic device comprising a power generating device for generating power through conversion from first energy to second energy in the form of electrical energy, a power supply device for accumulating the electrical energy produced by the power generation, a source-voltage transforming device for transforming a voltage of the electrical energy supplied from the power supply device and supplying the transformed voltage as driving power, and a driven device driven with the driving power supplied from the source-voltage transforming device, the method may comprise a transformation prohibiting step of prohibiting operation of the source-voltage transforming device when the voltage of the power supply device is lower than a predetermined voltage set in advance, and also when the amount of power generated by the power generating device is smaller than a predetermined amount of power set in advance; an accumulated-voltage detecting step of detecting a voltage during or after voltage accumulation in the power supply device when the operation of the source-voltage transforming device is prohibited; and a transforming factor control step of setting, in accordance with the voltage during or after the voltage accumulation in the power supply device, a transforming factor used after the operation-prohibited state of the source-voltage transforming device is released.

[4.8] Eighth Form

According to an eighth form of the present invention, in each of the above forms, the portable electronic device may include a time-measuring step of indicating the time of day.

ADVANTAGES

According to the present invention, it is detected whether or not a voltage generated by a power generator or generating means exceeds a preset limiter-ON voltage. When the voltage generated by the power generating means has not been reduced below the preset limiter-ON voltage, a voltage level of the electrical energy to be supplied to a power supply is limited to a predetermined reference voltage, set in advance. When it is determined, based on a detection result of a power-generation detector that power is not generated by the power generator, detecting operation of a limiter-ON-voltage detector is prohibited. Therefore, power consumption required for operating the limiter-ON-voltage detector can be reduced.

Also, when the generated voltage is not higher than a limiter control voltage that is lower than the limiter-ON voltage, the detecting operation of the limiter-ON-voltage detecting means is prohibited, and when the generated voltage exceeds the limiter control voltage, the detecting operation of the limiter-ON-voltage detector is allowed to run. Therefore, power consumption can be further reduced.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. A portable electronic device, comprising:

a power generator that selectively generates power through conversion of non-electrical energy to electrical energy;

a power supply that accumulates the electrical energy generated by the power generator;

a driven member that is driven by the electrical energy supplied from the power supply;

a power-generation detector that detects whether or not power is being generated by the power generator;

a limiter-ON-voltage detector that detects whether or not a voltage generated by the power generator or a voltage accumulated in the power supply exceeds a preset limiter-ON voltage;

a limiter that limits the voltage of the electrical energy to be supplied to the power supply to a predetermined reference voltage when it is determined, based on a detection result of the limiter-ON-voltage detector, that the voltage generated by the power generator or the voltage accumulated in the power supply exceeds the preset limiter-ON voltage; and a limiter-ON-voltage detector prohibitor that prohibits the detecting operation of the limiter-ON-voltage detector when it is determined, based on a detection result of the power-generation detector, that power is not being generated by the power generator.

2. A portable electronic device according to claim 1, wherein the limiter-ON-voltage detector prohibitor includes an operation stopping circuit that stops operation of the limiter-ON-voltage detector to prohibit its detecting operation.

3. A portable electronic device according to claim 1, further comprising:

a generated-voltage detector that detects a voltage generated by the power generator; and wherein the limiter-ON-voltage detector prohibitor includes a limiter-ON-voltage detection controller that prohibits the detecting operation of the limiter-ON-voltage detector when it is determined, based on a detection result of the generated-voltage detector, that the generated voltage does not exceed a predetermined limiter control voltage that is less than the limiter-ON voltage, and allows the detecting operation of the limiter-ON-voltage detector when the generated voltage exceeds the predetermined limiter control voltage.

4. A portable electronic device according to claim 3, further comprising:

a limiter-ON circuit that brings the limiter into an operative state when it is determined, based on the detection result of the limiter-ON-voltage detector, that the voltage generated by the power generator or the voltage accumulated in the power supply exceeds the preset limiter-ON voltage; and an operating-state controller that brings the limiter from an operative state into an inoperative state when it is determined, based on the detection result of the power-generation detector, that power is not being generated by the power generator or when it is determined, based on the detection result of the generated-voltage detector, that the generated voltage does not exceed the predetermined limiter control voltage which is less than the limiter-ON voltage.

5. A portable electronic device according to claim 1, wherein the limiter-ON-voltage detector detects whether or not the voltage accumulated in the power supply exceeds the preset limiter-ON voltage, with a cycle less than or equal to the cycle necessary for detecting a change of the voltage generated by the power generator.

6. A portable electronic device, comprising:

a power generator that selectively generates power through conversion of non-electrical energy to electrical energy;

a power supply that accumulates the electrical energy generated by the power generated;

a source-voltage stepper circuit that steps up a voltage of the electrical energy supplied from the power supply by a step-up factor N, where N is a real number greater than 1, and supplies the stepped-up voltage as driving power;

a driven member driven by the driving power supplied from the source-voltage stepper circuit;

a power-generation detector that detects whether or not power is generated by the power generator;

a limiter-ON-voltage detector that detects whether or not at least one of a voltage generated by the power generator, a voltage accumulated in the power supply and the stepped-up voltage of the driving power exceeds a preset limiter-ON voltage;

a limiter that limits the voltage of the electrical energy to be supplied to the power supply to a predetermined reference voltage when it is determined, based on a detection result of the limiter-ON-voltage detector, that at least one of the voltage generated by the power generator, the voltage accumulated in the power supply and the stepped-up voltage of the driving power exceeds the preset limiter-ON voltage;

a limiter-ON-voltage detector prohibitor that prohibits the detecting operation of the limiter-ON-voltage detector when it is determined, based on a detection result of the power-generation detector, that power is not being generated by the power generator; and a step-up factor changing circuit that changes the step-up factor from N to N', where N' is a real number and 1<N'<N, when it is determined, based on a detection result of the limiter-ON-voltage detector, that at least one of the voltage generated by the power generator, the voltage accumulated in the power supply and the stepped-up voltage of the driving power exceeds the preset limiter-ON voltage, and when the source-voltage stepper circuit is performing step-up operation.

7. A portable electronic device according to claim 6, wherein the step-up factor changing circuit includes:

a time-lapse determining circuit that determines whether or not a predetermined factor-change prohibiting time, measured from the time at which the step-up factor N was previously changed to N', has lapsed; and a change prohibitor that prohibits a change of the step-up factor until the predetermined factor-change prohibiting time lapses.

8. A portable electronic device, comprising:

a power generator that selectively generates power through conversion of non-electrical energy to electrical energy;

a power supply that accumulates the electrical energy generated by the power generator;

a source-voltage step-up/down circuit that steps up or down a voltage of the electrical energy supplied from the power supply at a step-up/down factor N, where N is a positive real number, and supplies the stepped-up/down voltage as driving power;

a driven member that is driven by the driving power supplied from the source-voltage step-up/down circuit;

a power-generation detector that detects whether or not power is being generated by the power generator;

a limiter-ON-voltage detector that detects whether or not at least one of a voltage generated by the power generator, a voltage accumulated in the power supply, and a stepped-up or stepped-down voltage of the driving power exceeds a preset limiter-ON voltage;

a limiter that limits the voltage of the electrical energy to be supplied to the power supply to a predetermined reference voltage when it is determined, based on a detection result of the limiter-ON-voltage detector, that at least one of the voltage generated by the power generator, the voltage accumulated in the power supply, and the stepped-up or stepped down voltage of the driving power exceeds the preset limiter-ON voltage;

a limiter-ON-voltage detector prohibitor that prohibits the detecting operation of the limiter-ON-voltage detector when it is determined, based on a detection result of the power-generation detector that power is not being generated by the power generator; and a step-up/down factor changing circuit that changes the step-up factor from N to N', where N' is a positive real number and N'<N, when it is determined, based on a detection result of the limiter-ON-voltage detector, that at least one of the voltage generated by the power generator, the voltage accumulated in the power supply, and the stepped-up or stepped-down voltage of the driving power exceeds the preset limiter-ON voltage.

9. A portable electronic device according to claim 8, wherein the step-up/down factor changing circuit includes:

a time-lapse determining circuit that determines whether or not a predetermined factor-change prohibiting time, measured from the time at which the step-up/down factor N was previously changed to N', has lapsed; and a change prohibitor that prohibits a change of the step-up/down factor until the predetermined factor-change prohibiting time lapses.

10. A portable electronic device according to claim 8 or 9, wherein the source-voltage step-up/down circuit has M, where M is an integer greater than or equal to 2, step-up/down capacitors for step-up/down operation, and in the step-up/down operation, L, where L is an integer greater than or equal to 2 but less than or equal to M, of the M step-up/down capacitors are connected in series to be charged with the electrical energy supplied from the power supply, and the L step-up/down capacitors are then connected in parallel to produce a voltage lower than the voltage of electrical energy supplied from the power supply, the produced lower voltage being used as a voltage after the step-down operation or being added to another voltage to produce a voltage after the step-up operation.

11. A portable electronic device according to claim 1, further comprising a limiter controller that brings the limiter into the inoperative state when power is not being generated by the power generator.

12. A portable electronic device according to claim 1, further comprising a limiter controller that brings the limiter into the inoperative state when an operating mode of the portable electronic device is in a power-saving mode.

13. A portable electronic device according to claim 1, wherein the power-generation detector detects whether or not power is being generated, in accordance with a level of the generated voltage and a duration of power generation by the power generator.

14. A portable electronic device, comprising:

a power generator that selectively generates power through conversion of non-electrical energy to electrical energy;

a power supply that accumulates the electrical energy generated by the power generator;

a driven member that is driven by the electrical energy supplied from the power supply;

a power-generation detector that detects whether or not power is being generated by the power generator;

a limiter-ON-voltage detector that detects whether or not a voltage generated by the power generator or a voltage accumulated in the power supply exceeds a preset limiter-ON voltage;

a limiter that limits the voltage of the electrical energy to be supplied to the power supply to a predetermined reference voltage when it is determined, based on a detection result of the limiter-ON-voltage detector, that the voltage generated by the power generator or the voltage accumulated in the power supply exceeds the preset limiter-ON voltage; and a limiter controller that brings the limiter into an inoperative state when power is not being generated.

15. A portable electronic device, comprising:

a power generator that selectively generates power through conversion of non-electrical energy to electrical energy;

a power supply that accumulates the electrical energy generated by the power generator;

a source-voltage transformer that transforms a voltage of the electrical energy supplied from the power supply and supplies the transformed voltage as driving power;

a driven member that is driven by the driving power supplied from the source-voltage transformer;

a transforming prohibitor that prohibits operation of the source-voltage transformer when the voltage of the power supply is lower than a predetermined voltage, and when the amount of power generated by the power generator is less than a predetermined amount of power;

an accumulated-voltage detector that detects a voltage during or after voltage accumulation in the power supply when the operation of the source-voltage transformer is prohibited; and a transforming factor controller that sets, in accordance with the voltage during or after the voltage accumulation in the power supply, a transforming factor used after the operation-prohibited state of the source-voltage transformer is released.

16. A portable electronic device according to claim 1, wherein the driven member includes a time-measuring indicator for indicating the time of day.

17. A control method for a portable electronic device comprising a power generating device for selectively generating power through conversion of non-electrical energy to electrical energy, a power supply device for accumulating the electrical energy generated by the power generating device, and a driven device driven by the electrical energy supplied from the power supply device, the method comprising the steps of:

detecting whether or not power is being generated by the power generating device;

detecting whether or not a voltage generated by the power generating device or a voltage accumulated in the power supply device exceeds a preset limiter-ON voltage;

limiting the voltage of the electrical energy to be supplied to the power supply device to a predetermined reference voltage when it is determined, based on a detection result in the voltage detecting step, that the voltage generated by the power generating device or the voltage accumulated in the power supply device exceeds the preset limiter-ON voltage; and prohibiting the detecting operation in the voltage detecting step when it is determined, based on a detection result in the power generation detecting step, that power is not being generated by the power generating device.

18. A control method for a portable electronic device comprising a power generating device for selectively generating power through conversion of non-electrical energy to electrical energy, a power supply device for accumulating the electrical energy generated by the power generating device, a source-voltage stepping-up device for stepping up a voltage of the electrical energy supplied from the power supply device at a step-up factor N, where N is a real number greater than 1, and supplying the stepped-up voltage as driving power, and a driven device driven by the driving power supplied from the source-voltage stepping-up device, the method comprising the steps of:

detecting whether or not power is generated by the power generating device;

detecting whether or not at least one of a voltage generated by the power generating device, a voltage accumulated in the power supply device and a stepped-up voltage of the driving power exceeds a preset limiter-ON voltage;

limiting the voltage of the electrical energy to be supplied to the power supply device to a predetermined reference voltage when it is determined, based on a detection result in the voltage detecting step, that at least one of the voltage generated by the power generating device, the voltage accumulated in the power supply device and the stepped-up voltage of the driving power exceeds the preset limiter-ON voltage;

prohibiting the detecting operation in the voltage detecting step when it is determined, based on a detection result in the power-generation detecting step, that power is not being generated by the power generating device; and changing the step-up factor from N to N', where N' is a real number and $1 \leqq N' < N$, when it is determined, based on a detection result in the voltage detecting step that at least one of the voltage generated by the power generating device, the voltage accumulated in the power supply device and the stepped-up voltage of the driving power exceeds the preset limiter-ON voltage, and when the source-voltage stepping-up device is performing step-up operation.

19. A control method for a portable electronic device comprising a power generating device for selectively generating power through conversion of non-electrical energy to electrical energy, a power supply device for accumulating the electrical energy produced by the power generating device, a source-voltage stepping-up/down device for stepping up or down a voltage of the electrical energy supplied from the power supply device at a step-up factor N, where N is a positive real number, and supplying the stepped-up/down voltage as driving power, a driven device driven by the driving power supplied from the source-voltage stepping-up/down device, and a power-generation detecting device for detecting whether or not power is generated by the power generating device, the method comprising the steps of:

detecting whether or not at least one of a voltage generated by the power generating device, a voltage accumulated in the power supply device, and a stepped-up or stepped-down voltage of the driving power exceeds a preset limiter-ON voltage;

limiting the voltage of the electrical energy to be supplied to the power supply device to a predetermined reference voltage when it is determined, based on a detection result in the voltage detecting step, that at least one of the voltage generated by the power generating device, the voltage accumulated in the power supply device, and the stepped-up or stepped-down voltage of the driving power exceeds the preset limiter-ON voltage;

prohibiting the detecting operation in the voltage detecting step when it is determined, based on a detection result of the power-generation detecting device, that power is not being generated by the power generating device; and changing the step-up factor from N to N', where N' is a positive real number and N'<N, when it is determined, based on a detection result in the voltage detecting step, that at least one of the voltage generated by the power generating device, the voltage accumulated in the power supply device, and the stepped-up or stepped-down voltage of the driving power exceeds the preset limiter-ON voltage.

20. A control method for a portable electronic device comprising a power generating device for selectively generating power through conversion of non-electrical energy to electrical energy, a power supply device for accumulating the electrical energy produced by the power generating device, a source-voltage transforming device for transforming a voltage of the electrical energy supplied from the power supply device and supplying the transformed voltage as driving power, and a driven device driven by the driving power supplied from the source-voltage transforming device, the method comprising the steps of:

prohibiting operation of the source-voltage transforming device when the voltage of the power supply device is lower than a predetermined voltage, and when the amount of power generated by the power generating device is less than a predetermined amount of power;

detecting a voltage during or after voltage accumulation in the power supply device when the operation of the source-voltage transforming device is prohibited; and setting, in accordance with the voltage during or after the voltage accumulation in the power supply device, a transforming factor used after the operation-prohibited state of the source-voltage transforming device is released.

* * * * *

UNITED STATES PATENT AND TRADEMARK OFFICE

CERTIFICATE OF CORRECTION

PATENT NO. : 6,343,051 B1
DATED : January 29, 2002
INVENTOR(S) : Hiroshi Yabe et al.

It is certified that error appears in the above-identified patent and that said Letters Patent is hereby corrected as shown below:

Column 39,
Line 33, change "1 < N' < N," to -- 1 ≤ N' < N, --

Signed and Sealed this

Seventeenth Day of September, 2002

*Attest:*

*Attesting Officer*

JAMES E. ROGAN
*Director of the United States Patent and Trademark Office*